US008594830B2

(12) United States Patent
Tokura

(10) Patent No.: US 8,594,830 B2
(45) Date of Patent: Nov. 26, 2013

(54) COMPUTER CONTROLLED EMBROIDERY SEWING MACHINE WITH IMAGE CAPTURING

(75) Inventor: Masashi Tokura, Konan (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 3 days.

(21) Appl. No.: 13/453,625

(22) Filed: Apr. 23, 2012

(65) Prior Publication Data

US 2012/0272884 A1 Nov. 1, 2012

(30) Foreign Application Priority Data

Apr. 27, 2011 (JP) ..... 2011-100001

(51) Int. Cl.
*D05C 5/06* (2006.01)

(52) U.S. Cl.
USPC ..... 700/137; 700/138

(58) Field of Classification Search
USPC ..... 700/136–138
See application file for complete search history.

(56) References Cited

U.S. PATENT DOCUMENTS

| | | | | |
|---|---|---|---|---|
| 5,151,863 | A * | 9/1992 | Komuro et al. | 700/138 |
| 5,283,747 | A * | 2/1994 | Komuro et al. | 700/138 |
| 6,167,822 | B1 * | 1/2001 | Miyasako et al. | 112/102.5 |
| 6,324,441 | B1 * | 11/2001 | Yamada | 700/138 |
| 8,061,286 | B2 * | 11/2011 | Hirata et al. | 112/470.01 |
| 8,090,466 | B2 * | 1/2012 | Yamada | 700/138 |
| 8,200,357 | B2 * | 6/2012 | Yamada | 700/138 |
| 8,463,420 | B2 * | 6/2013 | Tokura | 700/137 |
| 2010/0242817 | A1 | 9/2010 | Tokura | |
| 2011/0048301 | A1 | 3/2011 | Tokura | |

FOREIGN PATENT DOCUMENTS

| | | |
|---|---|---|
| JP | A-06-339588 | 12/1994 |
| JP | A-10-137467 | 5/1998 |
| JP | A-2005-073866 | 3/2005 |
| JP | A-2010-246885 | 11/2010 |
| JP | A-2011-050635 | 3/2011 |

OTHER PUBLICATIONS

U.S. Appl. No. 13/351,606, filed Jan. 17, 2012 in the name of Masashi Tokura.

* cited by examiner

*Primary Examiner* — Danny Worrell
(74) *Attorney, Agent, or Firm* — Oliff & Berridge, PLC

(57) ABSTRACT

A sewing machine that includes a first reference setting portion setting, as a first reference, a reference for a first pattern sewn in a first holding position, a first layout identification portion identifying, as a first marker layout, a marker for the first reference, a first reference change portion changing the first reference after the first marker layout is identified, a second layout identification portion identifying, as a second marker layout, a marker for the changed first reference, a second reference setting portion setting, as a second reference, a reference for a second pattern sewn in a second holding position, a third layout identification portion identifying, as a third marker layout, a marker for the first reference in the second holding position or the changed first reference, and a setting portion setting the second pattern for the sewing target object in the second holding position.

12 Claims, 24 Drawing Sheets

COMPUTER CONTROLLED EMBROIDERY SEWING MACHINE WITH IMAGE CAPTURING

CROSS-REFERENCE TO RELATED APPLICATION

This Application claims priority from JP2011-100001, filed on Apr. 27, 2011, the content of which is hereby incorporated by reference.

BACKGROUND

The present disclosure relates to a sewing machine provided with an image capturing device that is capable of capturing an image of a sewing target object held by an embroidery frame, and to a computer program product.

In related art, a sewing machine is known which uses an embroidery frame that holds a sewing target object and which performs embroidery sewing in a sewable area that is set inside the embroidery frame in accordance with a type of the embroidery frame. When an embroidery pattern that is larger than the sewable area is sewn, a sewing machine is known in which, for example, the embroidery pattern that is larger than the sewable area is divided into a plurality of patterns that are smaller than the sewable area, and sewing data corresponding to the plurality of patterns is stored. The sewing machine sequentially sews the plurality of divided patterns in accordance with the sewing data, and thereby sews the embroidery pattern that is larger than the sewable area. Every time one of the plurality of divided patterns is sewn, a user moves and adjusts a work cloth with respect to the embroidery frame so that the pattern to be sewn next is included in the sewable area. The above-described sewing machine automatically performs positioning between the plurality of divided patterns based on markers arranged on a surface of the work cloth.

SUMMARY

In the above-described sewing machine, a layout relationship between the plurality of divided patterns is determined by positioning a reference relating to the pattern to be sewn next, with respect to a reference relating to the pattern that is sewn first. The references for positioning the plurality of patterns are set in advance so that the plurality of patterns are sewn accurately such that they are adjacent to each other. Therefore, the user cannot flexibly set or change these references so that the plurality of patterns have a desired layout relationship.

The present disclosure provides a sewing machine that allows a user to flexibly set or change references for positioning between a plurality of patterns when the plurality of patterns are sewn in a range wider than a sewable range that is set inside an embroidery frame.

Embodiments provide a sewing machine that includes an image capturing device that is capable of capturing an image of a surface of a sewing target object held by an embroidery frame; a first reference setting portion that, if it is assumed that a first pattern is a pattern that is sewn in a state in which a holding position of the sewing target object with respect to the embroidery frame is a first holding position and it is also assumed that a second pattern is a pattern that is sewn in a state in which the holding position is a second holding position that is different from the first holding position, sets a reference relating to the first pattern as a first reference in accordance with an input command, the first reference being used to determine, as a relative layout of the second pattern, at least one of a position and an angle of the second pattern with respect to at least one of a position and an angle of the first pattern; a first image data acquisition portion that acquires, as first image data, image data of an image including a marker that is arranged on the surface of the sewing target object, the image being captured by the image capturing device in the state in which the holding position is the first holding position; a first layout identification portion that, based on the first reference and the first image data, identifies, as a first marker layout, at least one of a position and an angle of the marker with respect to the first reference in the first holding position; a first reference change portion that, when a change command, which is a command to change the first reference, is input after the first marker layout is identified by the first layout identification portion, changes the first reference in accordance with the change command, and sets the changed first reference; a second layout identification portion that, when the changed first reference is set by the first reference change portion, identifies, as a second marker layout, at least one of a position and an angle of the marker with respect to the changed first reference in the first holding position, based on the changed first reference and the first marker layout; a second reference setting portion that sets, as a second reference, a reference relating to the second pattern that is used to determine the relative layout of the second pattern, in accordance with an input command; a layout determination portion that determines the relative layout of the second pattern based on one of the first reference and the changed first reference and on the second reference; a second image data acquisition portion that acquires, as second image data, image data of an image including the marker that is arranged on the surface of the sewing target object, the image being captured by the image capturing device in the state in which the holding position is the second holding position; a third layout identification portion that, based on one of the first marker layout and the second marker layout and on the second image data, identifies, as a third marker layout, at least one of a position and an angle of the marker with respect to one of the first reference in the second holding position and the changed first reference; and a setting portion that, based on the relative layout of the second pattern and on the third marker layout, sets at least one of a position and an angle of the second pattern with respect to the sewing target object in the second holding position.

Embodiments also provide a computer program product stored on a non-transitory computer-readable medium, comprising instructions for causing a computer of a sewing machine to execute the steps of: setting, if it is assumed that a first pattern is a pattern that is sewn in a state in which a holding position of a sewing target object held by the embroidery frame is a first holding position and it is also assumed that a second pattern is a pattern that is sewn in a state in which the holding position is a second holding position that is different from the first holding position, a reference relating to the first pattern as a first reference in accordance with an input command, the first reference being used to determine, as a relative layout of the second pattern, at least one of a position and an angle of the second pattern with respect to at least one of a position and an angle of the first pattern; capturing an image of a surface of the sewing target object held by the embroidery frame in the state in which the holding position is the first holding position; acquiring, as first image data, image data of a captured image including a marker that is arranged on the surface of the sewing target object; identifying, as a first marker layout, at least one of a position and an angle of the marker with respect to the first reference in the first holding position, based on the first reference and the first image data; changing, when a change command, which is a command to change the first reference, is input after the first marker layout is identified, the first reference in accordance with the change command, and setting the changed first reference; identifying as a second marker layout, when the changed first reference is set, at least one of a position and an angle of the marker with respect to the changed first reference in the first holding position, based on the changed first reference and the first marker layout; setting, as a second reference, a reference relating to the second pattern that is used to determine the relative layout of the second pattern, in accordance with an input command; determining the relative layout of the second pattern based on one of the first reference and the changed first reference and on the second reference; capturing an image of the surface of the sewing target object held by the embroidery frame in the state in which the holding position is the second holding position; acquiring, as second image data, image data of a captured image including the marker that is arranged on the surface of the sewing target object; identifying, as a third marker layout, at least one of a position and an angle of the marker with respect to one of the first reference in the second holding position and the changed first reference, based on one of the first marker layout and the second marker layout and on the second image data; and setting, based on the relative layout of the second pattern and on the third marker layout, at least one of a position and an angle of the second pattern with respect to the sewing target object in the second holding position.

BRIEF DESCRIPTION OF THE DRAWINGS

Exemplary embodiments of the invention will be described below in detail with reference to the accompanying drawings in which.

DETAILED DESCRIPTION OF THE EXEMPLARY EMBODIMENTS

Hereinafter, embodiments of the present disclosure will be explained with reference to the drawings. A configuration of a multi-needle sewing machine (hereinafter simply referred to as a sewing machine) 1 according to an embodiment of the present disclosure will be explained with reference to FIG. 1 to FIG. 3. In the explanation below, the upper side, the lower side, the lower left side, the upper right side, the upper left side and the lower right side of FIG. 1 respectively correspond to the upper side, the lower side, the front side, the back side, the left side and the right side of the sewing machine 1.

Figure 1:
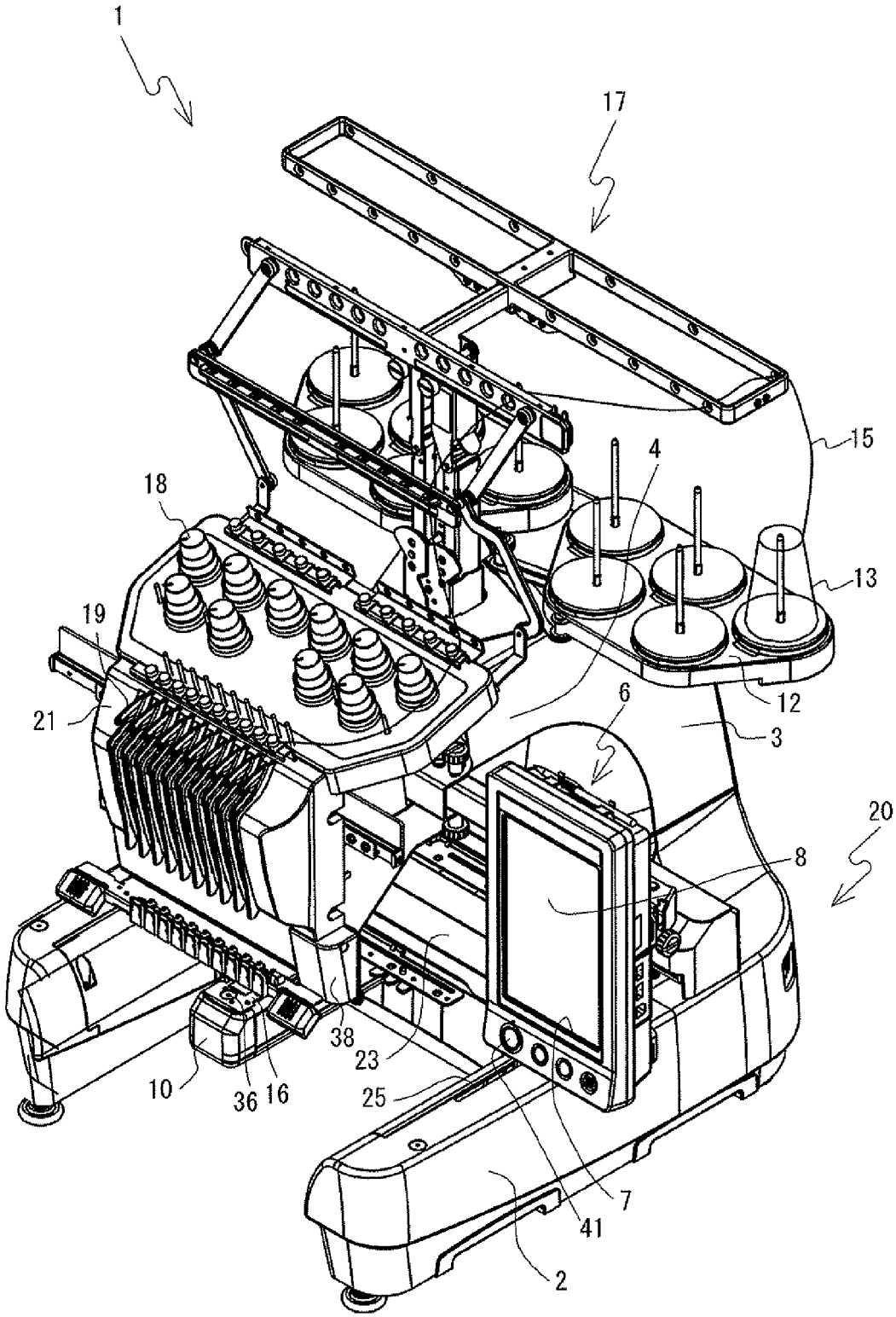
FIG. 1 is a perspective view of a multi-needle sewing machine 1.

As shown in FIG. 1, a main body 20 of the sewing machine 1 is provided with a support portion 2, a pillar 3 and an arm portion 4. The support portion 2 is formed in an inverted U-shape in a plan view, and supports the whole of the sewing machine 1. A pair of left and right guide grooves 25, which extend in a front-rear direction, are provided in an upper surface of the support portion 2. The pillar 3 is provided so as to extend upward from a rear end portion of the support portion 2. The arm portion 4 extends to the front from an upper end portion of the pillar 3. A needle bar case 21 is attached to the tip end of the arm portion 4 such that the needle bar case 21 can move in a left-right direction. Ten needle bars 31 (refer to FIG. 3), which extend in an up-down direction, are disposed inside the needle bar case 21 at an equal interval in the left-right direction. Of the ten needle bars 31, the needle bar 31 that is in a sewing position is caused to slide in the up-down direction by a needle bar drive mechanism 32 (refer to FIG. 3) that is provided inside the needle bar case 21. A needle 35 (refer to FIG. 3) is detachably attached to the lower end of each of the needle bars 31.

A cover 38 is provided on a lower portion of a right side surface of the needle bar case 21. An image sensor holding mechanism (not shown in the drawings) is attached to the inner side of the cover 38. The image sensor holding mechanism is provided with an image sensor 50 (refer to FIG. 3). The image sensor 50 is a known complementary metal oxide semiconductor (CMOS) image sensor. A lens (not shown in the drawings) of the image sensor 50 is directed below the sewing machine 1.

An operation portion 6 is provided on the right side of a central portion in the front-rear direction of the arm portion 4. The operation portion 6 is provided with a liquid crystal display (LCD) 7, a touch panel 8 and a start/stop switch 41. Various types of information, such as operation images used by a user to input a command, are displayed on the LCD 7. The touch panel 8 is used to receive a command from the user.

The user can select or set various types of conditions, such as a sewing pattern and a sewing condition, by performing a pressing operation (this operation is hereinafter referred to as a "panel operation"), using a finger or a touch pen, on sections of the touch panel 8 that correspond to positions of input keys etc. displayed on the LCD 7. The start/stop switch 41 is used to issue a command to start or stop sewing.

A cylinder-shaped cylinder bed 10, which extends to the front from a lower end portion of the pillar 3, is provided below the arm portion 4. A shuttle (not shown in the drawings) is provided inside a leading end portion of the cylinder bed 10. The shuttle houses a bobbin (not shown in the drawings) on which a bobbin thread (not shown in the drawings) is wound. A shuttle drive mechanism (not shown in the drawings) is provided inside the cylinder bed 10. The shuttle drive mechanism (not shown in the drawings) rotatably drives the shuttle. A needle plate 16, having a rectangular shape in a plan view, is provided on an upper surface of the cylinder bed 10. The needle plate 16 is provided with a needle hole 36 through which the needle 35 (refer to FIG. 3) passes.

A pair of left and right thread spool bases 12 are provided on a back surface side of an upper surface of the arm portion 4. The number of the thread spools 13 that can be mounted on the pair of the thread spool bases 12 is ten, which is the same as the number of the needle bars 31. A needle thread 15 is supplied from one of the thread spools 13 mounted on the thread spool bases 12. The needle thread 15 is supplied, via a thread guide 17, a tensioner 18, a thread take-up lever 19 and the like, to a needle hole (not shown in the drawings) of each of the needles 35 that is attached to the lower end of each of the needle bars 31.

A Y carriage 23 of an embroidery frame movement mechanism 11 (refer to FIG. 2) is provided below the arm portion 4. The embroidery frame movement mechanism 11 detachably supports an embroidery frame 84 (refer to FIG. 2). The embroidery frame 84 holds a sewing target object (such as a work cloth) 39. The embroidery frame movement mechanism 11 uses an X-axis motor 132 (refer to FIG. 3) and a Y-axis motor 134 (refer to FIG. 3) as driving sources, and thereby causes the embroidery frame 84 to move back and forth and left and right.

The embroidery frame 84 and the embroidery frame movement mechanism 11 will be explained with reference to FIG. 2. The embroidery frame 84 is provided with an outer frame 81, an inner frame 82 and a pair of left and right coupling portions 89. The outer frame 81 and the inner frame 82 of the embroidery frame 84 clamp the sewing target object 39. The user can change the holding position of the sewing target object 39 with respect to the embroidery frame 84, by changing sections of the sewing target object 39 clamped by the outer frame 81 and the inner frame 82. The coupling portions 89 are plate members having a rectangular shape in a plan view, and their central portions are cut out in a rectangular shape. One of the coupling portions 89 is fixed to a right portion of the inner frame 82 by screws 95 while the other of the coupling portions 89 is fixed to a left portion of the inner frame 82 by screws 94. In addition to the embroidery frame 84 exemplified in FIG. 2, a plurality of types of the embroidery frame 84 that are different in size and shape can be mounted on the sewing machine 1. The embroidery frame 84 exemplified in FIG. 2 has a width in the left-right direction (i.e., a distance between the left and right coupling portions 89) that is largest among the embroidery frames 84 that can be used for the sewing machine 1. A sewable area 86 is automatically set on the inner side of the inner frame 82 by a CPU 61 (refer to FIG. 3) of the sewing machine 1 in accordance with a type of the embroidery frame 84, based on an output signal of a known detector that is not shown in the drawings.

The embroidery frame movement mechanism 11 is provided with a holder 24, an X carriage 22, an X-axis drive mechanism (not shown in the drawings), the Y carriage 23 and a Y-axis movement mechanism (not shown in the drawings). The holder 24 detachably supports the embroidery frame 84. The holder 24 is provided with a mounting portion 91, a right arm portion 92 and a left arm portion 93. The mounting portion 91 is a plate member having a rectangular shape in a plan view, and it is longer in the left-right direction. The right arm portion 92 is a plate member extending in the front-rear direction, and it is fixed to the right end of the mounting portion 91. The left arm portion 93 is a plate member extending in the front-rear direction. The left arm portion 93 is fixed to a left portion of the mounting portion 91 such that the position in the left-right direction with respect to the mounting portion 91 can be adjusted. The right arm portion 92 is engaged with the one of the coupling portions 89 of the embroidery frame 84 while the left arm portion 93 is engaged with the other of the coupling portions 89.

The X carriage 22 is a plate member and is longer in the left-right direction. A part of the X carriage 22 protrudes toward the front from the front face of the Y carriage 23. The mounting portion 91 of the holder 24 is attached to the X carriage 22. The X-axis drive mechanism (not shown in the drawings) is provided with a linear movement mechanism (not shown in the drawings). The linear movement mechanism is provided with a timing pulley (not shown in the drawings) and a timing belt (not shown in the drawings). The linear movement mechanism causes the X carriage 22 to move in the left-right direction (in the X-axis direction) using the X-axis motor 132 as a driving source.

The Y carriage 23 has a box shape and is longer in the left-right direction. The Y carriage 23 supports the X carriage 22 such that the X carriage 22 can move in the left-right direction. The Y-axis movement mechanism (not shown in the drawings) is provided with a pair of left and right movable objects (not shown in the drawings) and a linear movement mechanism (not shown in the drawings). The movable objects are connected to lower portions of the left and right ends of the Y carriage 23, and vertically pass through the guide grooves 25 (refer to FIG. 1). The linear movement mechanism is provided with a timing pulley (not shown in the drawings) and a timing belt (not shown in the drawings). The linear movement mechanism causes the movable objects to move in the front-rear direction (in the Y-axis direction) along the guide grooves 25, using the Y-axis motor 134 as a driving source. The Y carriage 23 that is connected to the movable objects, and the X carriage 22 that is supported by the Y carriage 23 move in the front-rear direction (in the Y-axis direction) in accordance with movement of the movable objects. When the embroidery frame 84 that holds the sewing target object 39 is attached to the X carriage 22, the sewing target object 39 is disposed between the needle bars 31 and the needle plate 16 (refer to FIG. 1).

Figure 3:
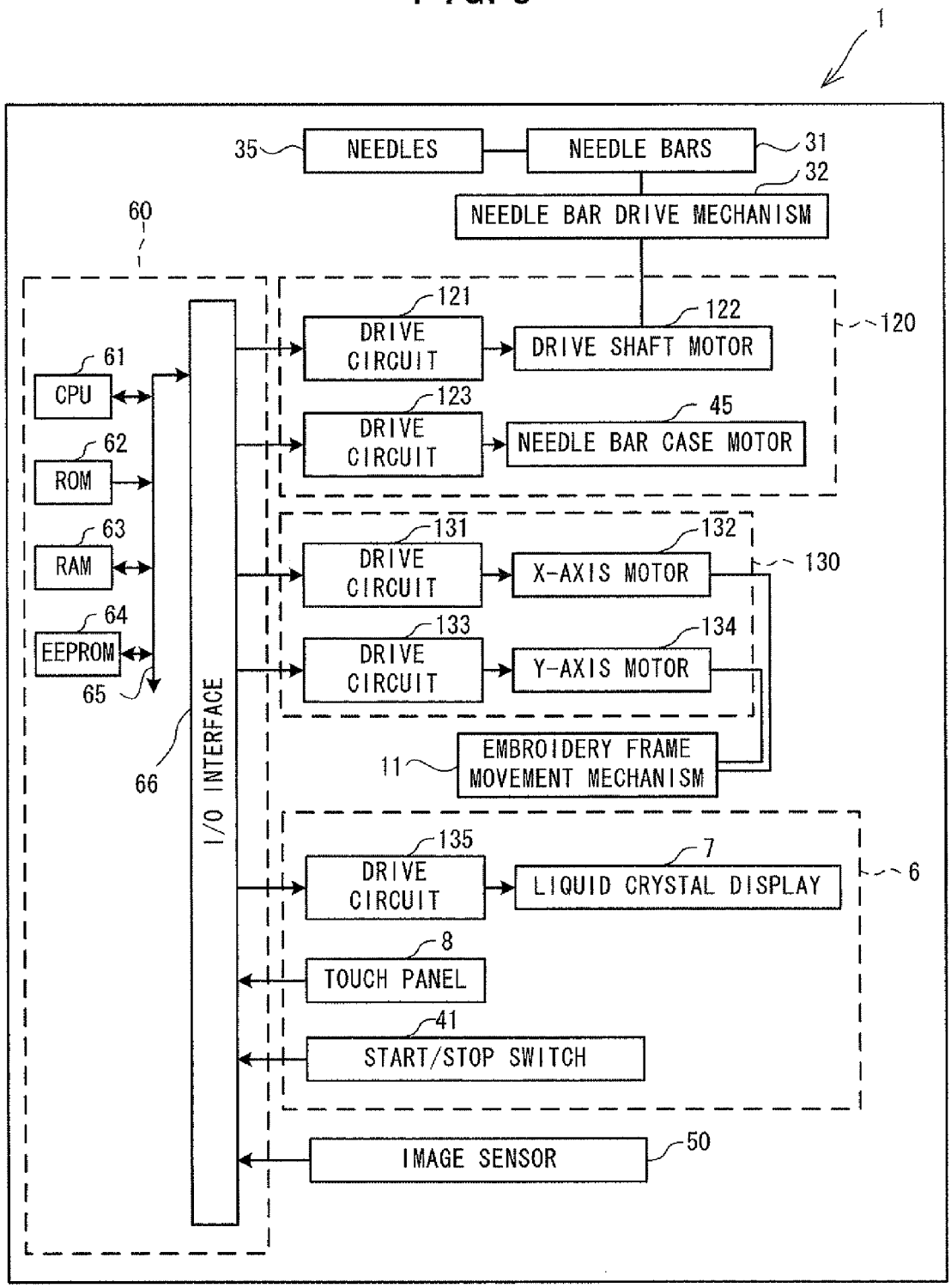
FIG. 3 is a block diagram showing an electrical configuration of the multi-needle sewing machine 1.

An electrical configuration of the sewing machine 1 will be explained with reference to FIG. 3. The sewing machine 1 is provided with a needle drive portion 120, a sewing target drive portion 130, the operation portion 6, a control portion 60 and the image sensor 50.

The needle drive portion 120 is provided with a needle bar case motor 45, drive circuits 121 and 123, and a drive shaft motor 122. The drive shaft motor 122 drives the needle bar drive mechanism 32 and causes the needle bar 31 to reciprocate in the up-down direction. The drive circuit 121 drives the drive shaft motor 122 in accordance with a control signal from the control portion 60. The needle bar case motor 45 causes the needle bar case 21 to move in the left-right direction. The drive circuit 123 drives the needle bar case motor 45 in accordance with a control signal from the control portion 60.

The sewing target drive portion 130 is provided with drive circuits 131 and 133, the X-axis motor 132 and the Y-axis motor 134. The X-axis motor 132 drives the embroidery frame movement mechanism 11 and thereby causes the embroidery frame 84 (refer to FIG. 2) to move in the left-right direction. The drive circuit 131 drives the X-axis motor 132 in accordance with a control signal from the control portion 60. The Y-axis motor 134 drives the embroidery frame movement mechanism 11 and thereby causes the embroidery frame 84 to move in the front-rear direction. The drive circuit 133 drives the Y-axis motor 134 in accordance with a control signal from the control portion 60.

The operation portion 6 is provided with the touch panel 8, a drive circuit 135, the LCD 7 and the start/stop switch 41. The drive circuit 135 drives the LCD 7 in accordance with a control signal from the control portion 60.

The control portion 60 is provided with the CPU 61, a ROM 62, a RAM 63, an EEPROM 64 and an input/output interface (I/O) 66, and they are mutually connected by a signal line 65. The needle drive portion 120, the sewing target drive portion 130, the operation portion 6 and the image sensor 50 are respectively connected to the I/O interface 66.

The CPU 61 performs main control of the sewing machine 1. The CPU 61 performs various operations and processing that relate to sewing, in accordance with various programs stored in a program storage area (not shown in the drawings) of the ROM 62. Although not shown in the drawings, the ROM 62 is provided with a plurality of storage areas including the program storage area and a pattern storage area. Various programs to operate the sewing machine 1, including a main program, are stored in the program storage area. The main program is a program to perform main processing, which will be described later. Sewing data, which is data to sew a pattern (hereinafter also referred to as an "embroidery pattern"), is stored in the pattern storage area. The RAM 63 includes, if necessary, a storage area to store operation results etc. processed by the CPU 61. Various parameters for the sewing machine 1 to perform various types of processing are stored in the EEPROM 64. Further, each of the needle bars 31, and the color of the needle thread 15 that is supplied to the needle hole (not shown in the drawings) of the needle 35 that is attached to the lower end of each of the needle bars 31, are associated and stored in the EEPROM 64. The sewing data may be stored in the EEPROM 64.

Operations of the sewing machine 1 to form stitches on the sewing target object 39 held by the embroidery frame 84 will be explained with reference to FIG. 1 to FIG. 3. The embroidery frame 84 that holds the sewing target object 39 is supported by the embroidery frame movement mechanism 11. One of the ten needle bars 31 is selected by movement of the needle bar case 21 from side to side. The embroidery frame 84 is moved to a predetermined position by the embroidery frame movement mechanism 11. When a drive shaft (not shown in the drawings) is driven and rotated by the drive shaft motor 122, the needle bar drive mechanism 32 and a thread take-up lever drive mechanism (not shown in the drawings) are driven, and the selected needle bar 31 and the thread take-up lever 19 corresponding to the selected needle bar 31 are vertically driven. Further, the shuttle drive mechanism is driven by rotation of the drive shaft motor 122, and the shuttle is driven and rotated. In this way, the needle 35, the thread take-up lever 19 and the shuttle are driven in a synchronized manner, and stitches are formed on the sewing target object 39.

Sewing data of the present embodiment will be explained with reference to FIG. 2. The sewing data of the present embodiment includes coordinate data of an embroidery coordinate system 100 shown in FIG. 2. The embroidery coordinate system 100 is a coordinate system of the X-axis motor 132 that causes the X carriage 22 to move and the Y-axis motor 134. The coordinate data of the embroidery coordinate system 100 represents a position and an angle of the embroidery pattern with respect to a reference (for example, the X carriage 22). The embroidery frame 84 that holds the sewing target object 39 is attached to the X carriage 22. Therefore, the coordinate data of the embroidery coordinate system 100 represents the position and the angle of the embroidery pattern with respect to the sewing target object 39 held by the embroidery frame 84. In the present embodiment, the embroidery coordinate system 100 and a world coordinate system are associated with each other in advance. The world coordinate system is a coordinate system that shows the whole space. The world coordinate system is a coordinate system that is not affected by the center of gravity etc. of an image capturing target object.

Figure 2:
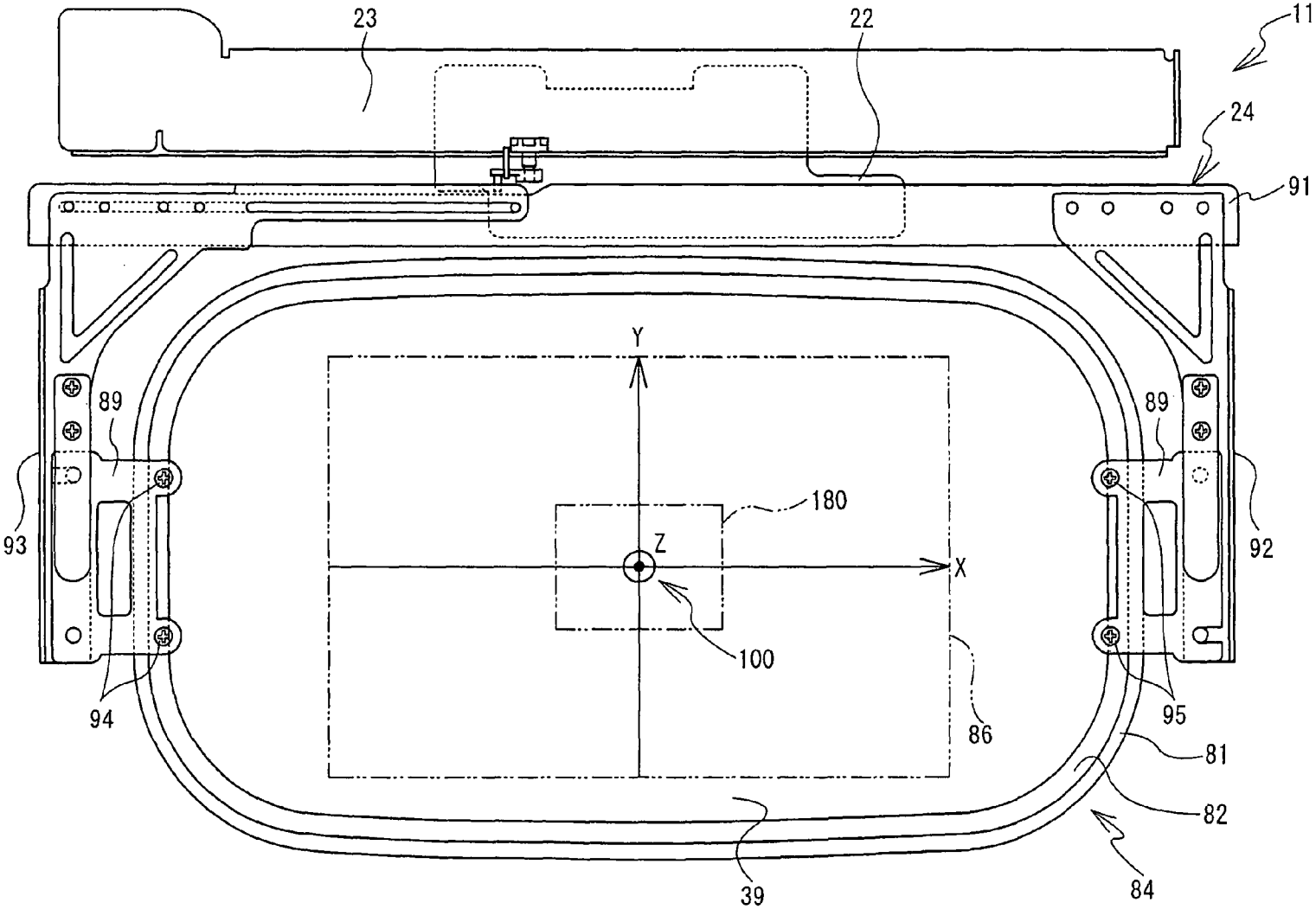
FIG. 2 is a plan view of an embroidery frame movement mechanism 11 that holds an embroidery frame 84.

As shown in FIG. 2, in the embroidery coordinate system 100, a direction from the left toward the right of the sewing machine 1 is an X-axis plus direction, and a direction from the front toward the rear of the sewing machine 1 is a Y-axis plus direction. In the present embodiment, an initial position of the embroidery frame 84 is set as the origin (X, Y, Z)=(0, 0, 0) of the embroidery coordinate system 100. The initial position of the embroidery frame 84 is a position at which a center point of the sewable area 86 corresponding to the embroidery frame 84 matches a needle drop point. The needle drop point is a point at which the needle 35 (refer to FIG. 3) disposed vertically above the needle hole 36 (refer to FIG. 1) pierces the sewing target object 39 when the needle bar 31 is moved downwardly from above the sewing target object 39. The embroidery frame movement mechanism 11 of the present embodiment does not cause the embroidery frame 84 to move in a Z direction (the up-down direction of the sewing machine 1). Therefore, if the thickness of the sewing target object 39 is within a negligible range, an upper surface of the sewing target object 39 is taken as Z=0.

Coordinate data of the sewing data stored in the ROM 62 defines an initial layout of the embroidery pattern. The initial layout of the embroidery pattern is set such that a center point of the embroidery pattern matches the center point of the sewable area 86. The coordinate data of the sewing data is appropriately corrected when the layout of the embroidery pattern with respect to the sewing target object 39 is changed. In the present embodiment, the layout of the embroidery pattern with respect to the sewing target object 39 is set in accordance with the main processing, which will be described later. In the explanation below, the position of the embroidery pattern (the center point of the embroidery pattern) and the angle of the embroidery pattern are set with respect to the sewing target object 39 held by the embroidery frame 84, using data represented by the embroidery coordinate system 100.

An image capturing range of the image sensor 50 (refer to FIG. 3) will be explained with reference to FIG. 2. When the image sensor 50 is disposed in an image capturing position, an image capturing range of the image sensor 50 in an X-Y plane of the embroidery coordinate system 100 is a rectangular range centered on a point that is directly below the center of the lens of the image sensor 50. A length of the rectangular range in the left-right direction is approximately 80 mm, and a length in the front-rear direction is approximately 60 mm. The image capturing position of the present embodiment is a position at which the center of the lens of the image sensor 50 is disposed directly above the needle hole 36. When the image sensor 50 is disposed in the image capturing position and the embroidery frame 84 is disposed in the initial position, an image capturing range 180 is a rectangular range centered on the origin of the embroidery coordinate system 100 as shown in FIG. 2.

Figure 4:
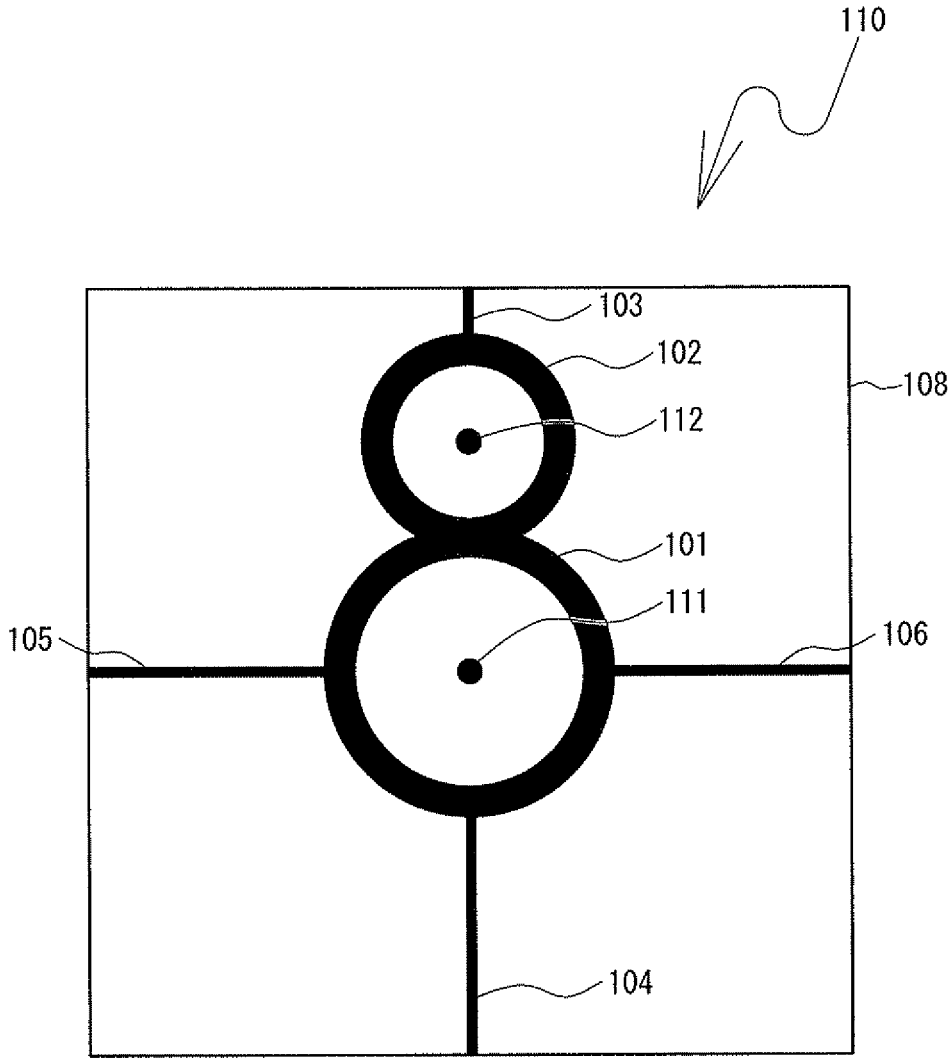
FIG. 4 is a plan view of a marker 110.

A marker 110 will be explained with reference to FIG. 4. The explanation will be made assuming that the upper side, the lower side, the left side and the right side of FIG. 4 respectively correspond to the upper side, the lower side, the left side and the right side of the pattern drawn in the marker 110. The marker 110 is made such that the pattern is drawn on an upper surface of a white base sheet 108 having a thin plate shape. The base sheet 108 has a square shape in which the length is 2.5 cm and the width is 2.5 cm, for example. A first circle 101, a second circle 102, a first center point 111 and a second center point 112 are drawn on the upper surface of the base sheet 108. The second circle 102 is arranged above the first circle 101. The diameter of the second circle 102 is smaller than the diameter of the first circle 101. The first center point 111 is the center of the first circle 101. The second center point 112 is the center of the second circle 102. Further, line segments 103 to 106 are drawn on the upper surface of the base sheet 108. The line segment 103 and the line segment 104 overlap with a virtual straight line (not shown in the drawings) that passes through the first center point 111 and the second center point 112. The line segment 105 and the line segment 106 overlap with a virtual straight line (not shown in the drawings) that passes through the first center point 111 of the first circle 101 and that is orthogonal to the line segment 103. The line segments 103 to 106 are respectively drawn to the outer edges of the base sheet 108.

A transparent adhesive is applied to a back surface of the base sheet 108. It is therefore possible to adhere the base sheet 108 onto the sewing target object 39. Normally, the base sheet 108 is adhered to a release paper (not shown in the drawings). The user peels the base sheet 108 from the release paper and uses it.

The main processing that is performed by the sewing machine 1 will be explained with reference to FIG. 5 to FIG. 18. In the main processing of the present embodiment, when a plurality of patterns are sewn in a range larger than the sewable area 86 that is set inside the embroidery frame 84 (refer to FIG. 2), the layout between the patterns is adjusted in accordance with a command from the user. Hereinafter, as a specific example, a case will be explained in which a plurality of patterns 205, an example of which is shown in FIG. 6, are arranged and sewn in accordance with a command input by the user. The size of the pattern 205 is set such that the length in the X-axis direction is 186.8 mm and the length in the Y-axis direction is 133.0 mm. When the size of the sewable area 86 is set such that the length in the X-axis direction is 360 mm and the length in the Y-axis direction is 200 mm, the single pattern 205 falls within the sewable area 86. However, when the two patterns 205 are arranged such that they are in contact with each other without overlapping in the X-axis direction or the Y-axis direction, the two patterns 205 do not fall within the sewable area 86. Further, when the two patterns 205 are arranged side by side with a predetermined interval therebetween, the two patterns 205 do not fall within the sewable area 86.

Figure 5:
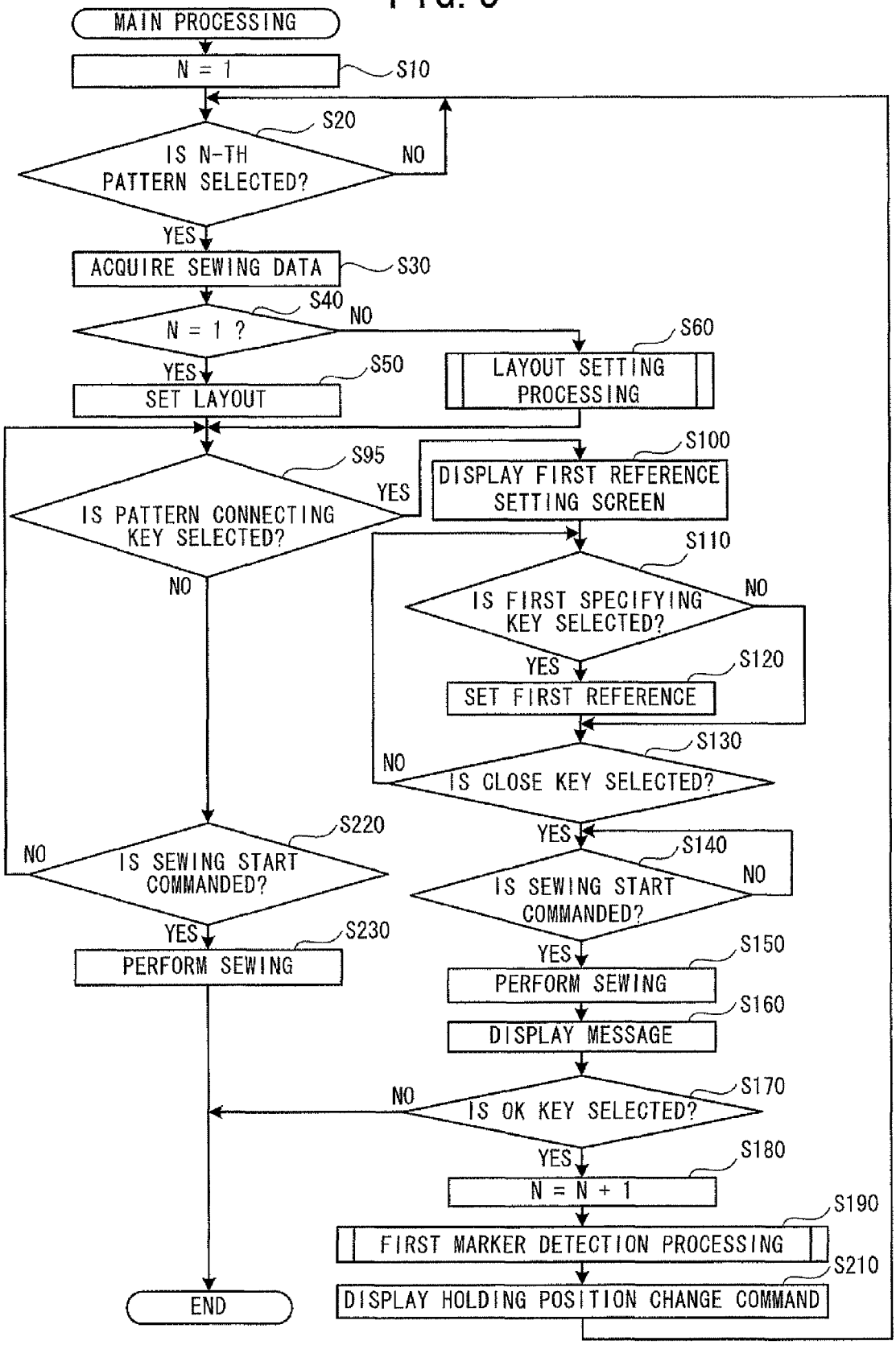
FIG. 5 is a flowchart of main processing.
Figure 6:
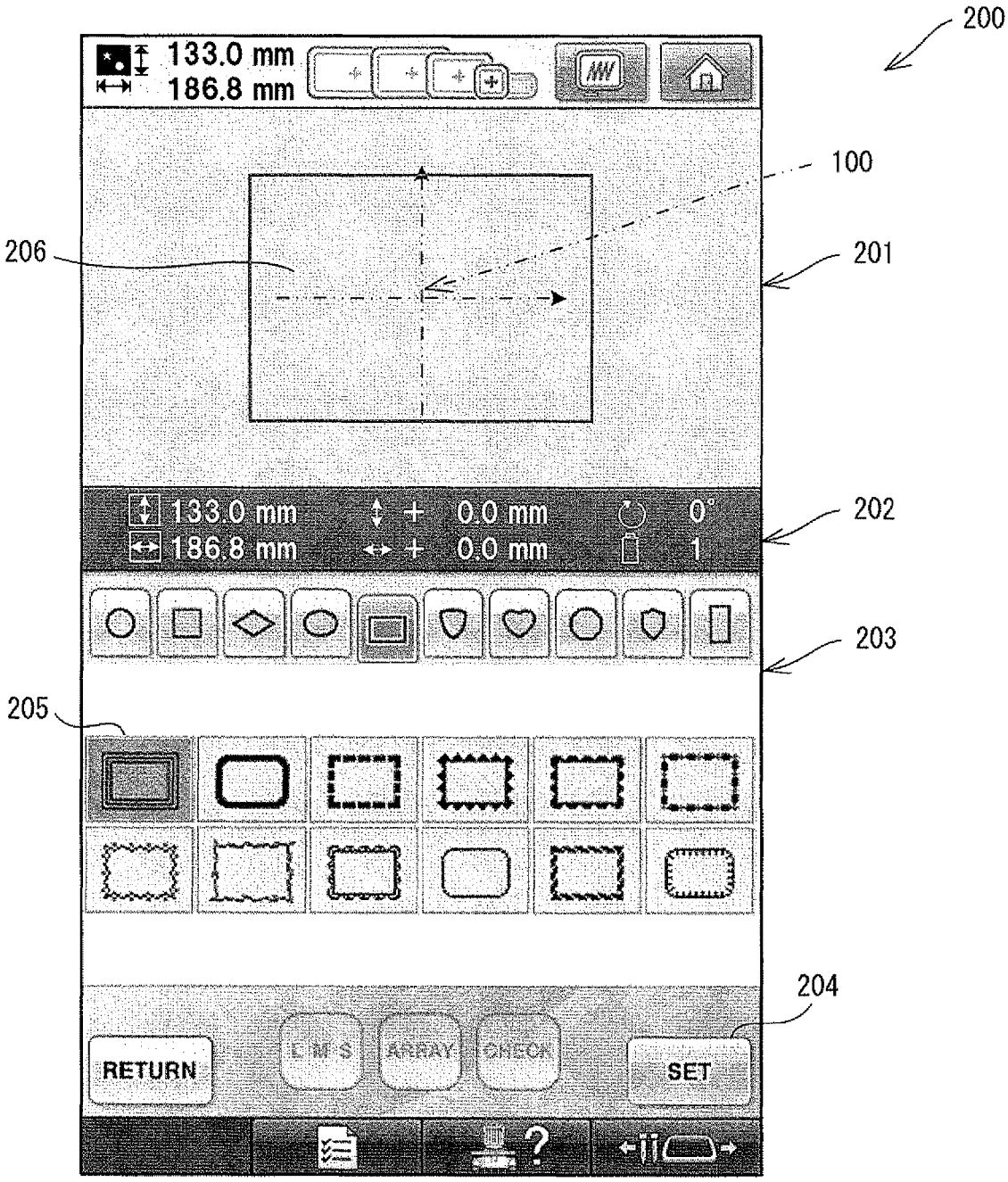
FIG. 6 is an explanatory diagram of a screen 200.

The main processing shown in FIG. 5 is performed when the user inputs a command to start the main processing. The command to start the main processing is input by a panel operation, for example. The program to perform the main processing is stored in the ROM 62 (refer to FIG. 3) and is performed by the CPU 61. Various screens and messages shown as examples are displayed on the LCD 7 when a control signal is output to the drive circuit 135. In the various screens that are shown as examples, the left-right direction and the up-down direction of the drawings are respectively referred to as the left-right direction and the up-down direction of the screens.

In the main processing, first, a variable N is set to 1 and the set variable N is stored in the RAM 63 (step S10). The variable N is a variable to count the number of the patterns selected by the user. The variable N corresponds to a sewing order of the selected patterns. The CPU 61 stands by until an N-th pattern is selected (no at step S20). At step S20, first, a screen 200 exemplified in FIG. 6 is displayed. A pattern display column 201, a pattern information column 202, a pattern selection column 203 and a SET key 204 are displayed on the screen 200.

A graphic that represents a range in which the currently selected pattern is to be sewn is displayed in the pattern display column 201. The size of the pattern display column 201 represents the maximum size of the sewable area 86 that is set for the sewing machine 1. More specifically, the size of the pattern display column 201 corresponds to the size of the sewable area 86 that is set when the embroidery frame 84 exemplified in FIG. 2 is attached. The left-right direction of the pattern display column 201 corresponds to the X-axis direction of the embroidery coordinate system 100. The up-down direction of the pattern display column 201 corresponds to the Y-axis direction of the embroidery coordinate system 100. In the present embodiment, the graphic that represents the range in which a pattern is sewn is shown by a rectangle. In a state before the layout of the pattern 205 is changed, a rectangle 206 that represents the range in which the pattern 205 is sewn includes sides that are parallel in the left-right direction of the pattern display column 201, and sides that are parallel in the direction perpendicular to the up-down direction of the pattern display column 201. The size of the above-described rectangle, a movement distance and a rotation angle with respect to the initial layout of the pattern, and the number of thread colors that are necessary for sewing are displayed in the pattern information column 202, as information relating to the currently selected pattern.

Pattern candidates are displayed in the pattern selection column 203 based on the sewing data stored in the ROM 62 or the EEPROM 64. The user selects a desired pattern by a panel operation from among the patterns displayed in the pattern selection column 203. After the pattern is selected, the SET key 204 is selected. At step S20, when one of the patterns is selected from among the patterns in the pattern selection column 203 by the panel operation and thereafter the SET key 204 is selected, it is determined that the N-th pattern is selected (yes at step S20). In this case, the sewing data corresponding to the selected N-th pattern is acquired from the ROM 62 or the EEPROM 64 and the acquired sewing data is stored in the RAM 63 (step S30).

On the screen 200, when the SET key 204 is selected after the pattern 205 is selected as a first pattern (yes at step S20, step S30, yes at step S40), the layout of the first pattern is set (step S50). Specifically, the sewing data of the first pattern acquired at step S30 is corrected by a known method in accordance with editing content of the pattern specified by the user, and thus the layout of the first pattern is set.

Figure 7:
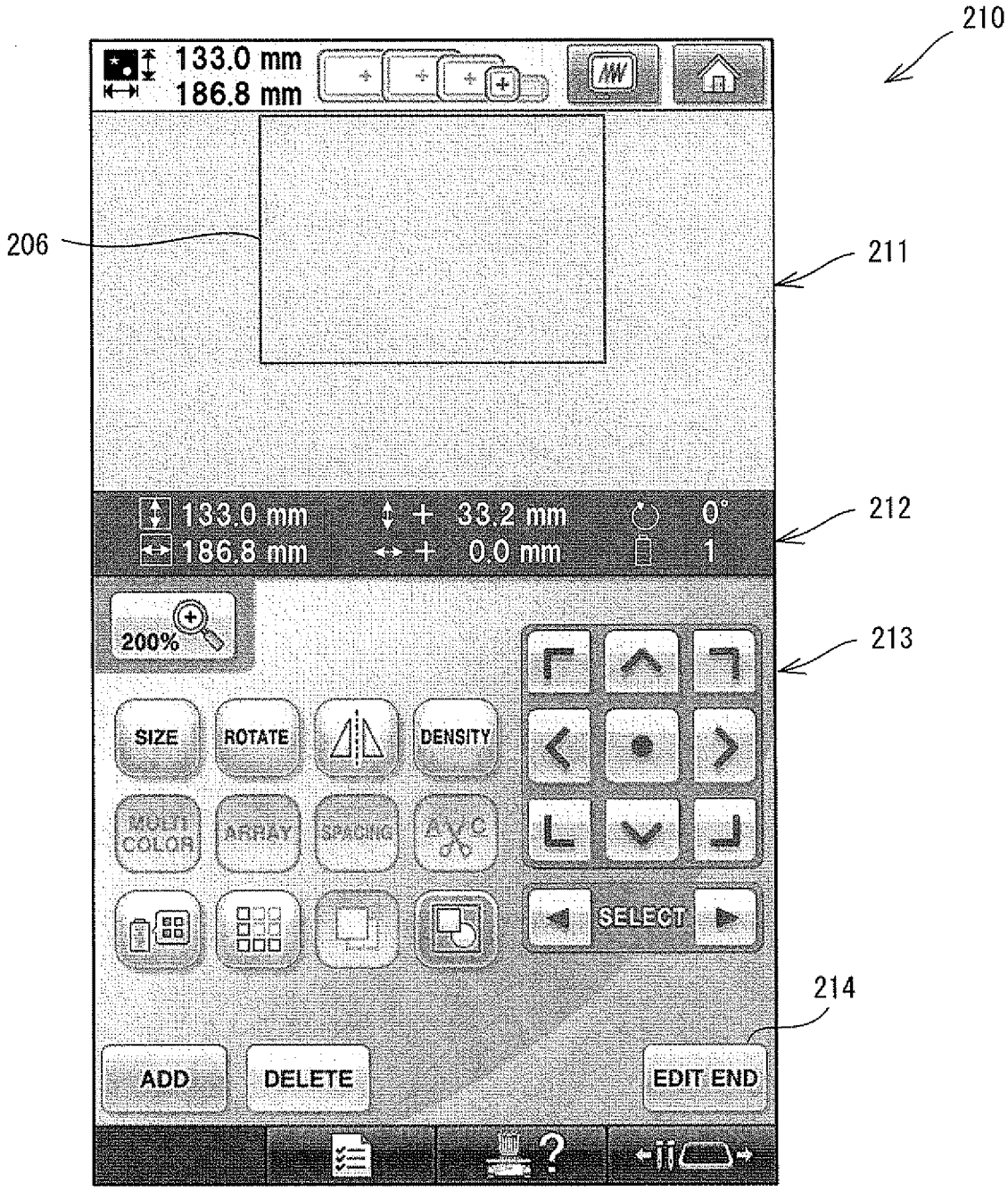
FIG. 7 is an explanatory diagram of a screen 210.

At step S50, a screen 210 exemplified in FIG. 7 is displayed. A pattern display column 211, a pattern information column 212, a pattern editing column 213 and an EDIT END key 214 are displayed on the screen 210. The pattern display column 211 is similar to the pattern display column 201, and the pattern information column 212 is similar to the pattern information column 202. Various types of keys, which are used to command the pattern editing, are displayed in the pattern editing column 213. The user can command the pattern editing by selecting the keys displayed in the pattern editing column 213 by panel operations. Examples of the pattern editing include a size change of the pattern, rotation of the pattern with respect to an initial layout, reversal of the pattern, and movement of the pattern with respect to the initial layout. The initial layout of the pattern is defined by the sewing data as described above. When the pattern editing is performed, the rectangle that represents the range in which the pattern is sewn is displayed in the pattern display column 201 at the position and angle that correspond to the editing content. After the pattern editing and layout is completed, the EDIT END key 214 is selected. When the EDIT END key 214 is selected, the specified editing content is ascertained. The sewing data is corrected based on the specified editing content and the corrected sewing data is stored in the RAM 63.

In FIG. 7, the screen 210 is shown for the case where the rectangle 206 corresponding to the pattern 205 is moved by +33.2 mm in the Y-axis direction with respect to the initial layout. Therefore, the rectangle 206 in the pattern display column 211 is located on the screen 210 at a position that is 33.2 mm above the rectangle 206 at the initial position shown in FIG. 6. When the EDIT END key 214 is selected after the pattern editing has been performed in this way, a screen including a sewing start key and a pattern connecting key (which are not shown in the drawings) is displayed on the LCD 7. The sewing start key is selected to command start of the sewing of the pattern. The pattern connecting key is selected when an (N+1)-th pattern is sewn in addition to the N-th pattern selected at step S20, and also when the whole of the N-th pattern and the (N+1)-th pattern is sewn in a range that is larger than the sewable area 86.

It is determined whether the pattern connecting key has been selected (step S95). When the pattern connecting key has been selected (yes at step S95), processing to set a first reference is performed. The first reference is a reference with respect to the first pattern, and is used when the layout of a second pattern with respect to the layout of the first pattern is determined. Here, the N-th pattern (or an (N−1)-th pattern) that is sewn in a first holding position is referred to as the first pattern, and the (N+1)-th pattern (or the N-th pattern) that is sewn in a second holding position is referred to as the second pattern. Among the holding positions of the sewing target object 39 with respect to the embroidery frame 84, the first holding position and the second holding position are holding positions that are set by the user and that are different from each other.

Figure 8:
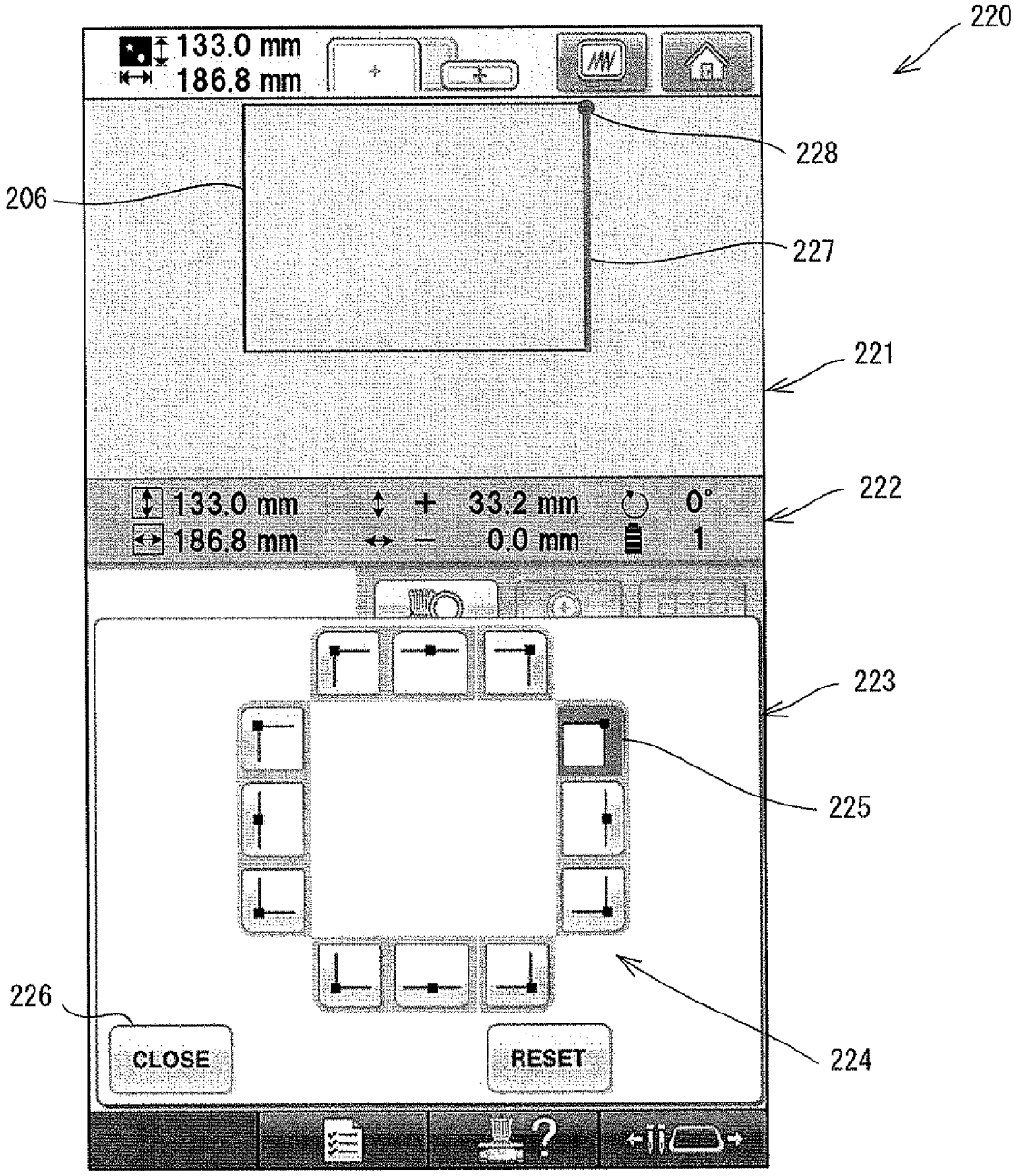
FIG. 8 is an explanatory diagram of a first reference setting screen 220.

Firstly, a first reference setting screen 220 exemplified in FIG. 8 is displayed (step S100). A pattern display column 221, a pattern information column 222 and a command key display column 223 are displayed on the first reference setting screen 220. The pattern display column 221 is similar to the pattern display column 201, and the pattern information column 222 is similar to the pattern information column 202. A group of first specifying keys 224 and a CLOSE key 226 are displayed in the command key display column 223. Each of the first specifying keys included in the group of first specifying keys 224 is a key to specify the first reference.

The first reference is a reference specified by the user, for example, and includes at least one of a first line segment 227 and a first point 228 that are included in a first graphic. The first reference of the present embodiment includes the first line segment 227 and the first point 228. The first graphic is a graphic representing a range in which the first pattern (the N-th pattern) is sewn. In the present embodiment, the first graphic is the smallest rectangle in which the first pattern can be arranged. The first line segment 227 is selected from among four sides of the smallest rectangle. The first point 228 is selected from among both end points of the first line segment 227 and a midpoint of the first line segment 227. In the present embodiment, a combination of the first line segment 227 and the first point 228 is selected as the first reference, from among the twelve first specifying keys included in the group of first specifying keys 224. After the first reference has been specified, the CLOSE key 226 is selected.

It is determined whether one of the first specifying keys is selected from among the group of first specifying keys 224 (step S110). When one of the first specifying keys is selected from among the group of first specifying keys 224 on the first reference setting screen 220 (yes at step S110), the first reference specified by the first specifying key is set. The set first reference is stored in the RAM 63 (step S120). The layout of the first reference (the first line segment 227 and the first point 228) in the rectangle corresponding to the first pattern can be identified based on the sewing data of that pattern. Note that, in a case where the pattern is edited at step S50 of the main processing and the sewing data is corrected, the layout of the first reference in the rectangle corresponding to the first pattern can be identified based on the corrected sewing data. The layout of the first line segment 227 and the first point 228 in the first holding position identified by the coordinates of the embroidery coordinate system is stored in the RAM 63.

Further, at step S120, the first reference (i.e., the first line segment 227 and the first point 228), which is set to the rectangle that corresponds to the first pattern, is added to the rectangle and displayed in the pattern display column 221. The first line segment 227 and the first point 228 exemplified in FIG. 8 are associated with a first specifying key 225 that is used to specify the combination of the right side of the rectangle 206 and the upper end point of the right side. The sewing machine 1 of the present embodiment displays the rectangle 206 in black, the first line segment 227 in blue, and the first point 228 in red, respectively, so that the user can easily visually check the first reference with respect to the rectangle 206. The layout of the rectangle 206 is identified by the sewing data represented by the embroidery coordinate system.

When none of the first specifying keys is selected from among the group of first specifying keys 224 (no at step S110), or after the first reference is set at step S120, it is determined whether the CLOSE key 226 has been selected (step S130). When the CLOSE key 226 has not been selected (no at step S130), the processing returns to step S110. When the CLOSE key 226 has been selected (yes at step S130), a screen including the sewing start key (not shown in the drawings) is displayed on the LCD 7, instead of the first reference setting screen 220.

It is determined whether a sewing start command has been input (step S140). When the user inputs the sewing start command, the user selects the sewing start key displayed on the screen. The CPU 61 stands by until the sewing start key is selected (no at step S140). When the sewing start key has been selected (yes at step S140), sewing of the N-th pattern is performed (step S150). Specifically, a control signal is output to the drive circuits 131 and 133 in accordance with the sewing data of the N-th pattern, and the embroidery frame 84 is moved. A control signal is output to the drive circuit 121 and the drive shaft motor 122 is driven.

Next, although not shown in the drawings, a message "Sew the next pattern?" and an OK key are displayed on the LCD 7 (step S160). The message is displayed to verify with the user whether to perform processing to sew the next pattern (the (N+1)-th pattern). The OK key is selected when the processing to sew the next pattern is performed. When the OK key is not selected for a predetermined time period (for five minutes, for example) (no at step S170), the main processing ends. When the OK key is selected (yes at step S170), the variable N is incremented by 1 and the incremented variable N is stored in the RAM 63 (step S180).

Figure 9:
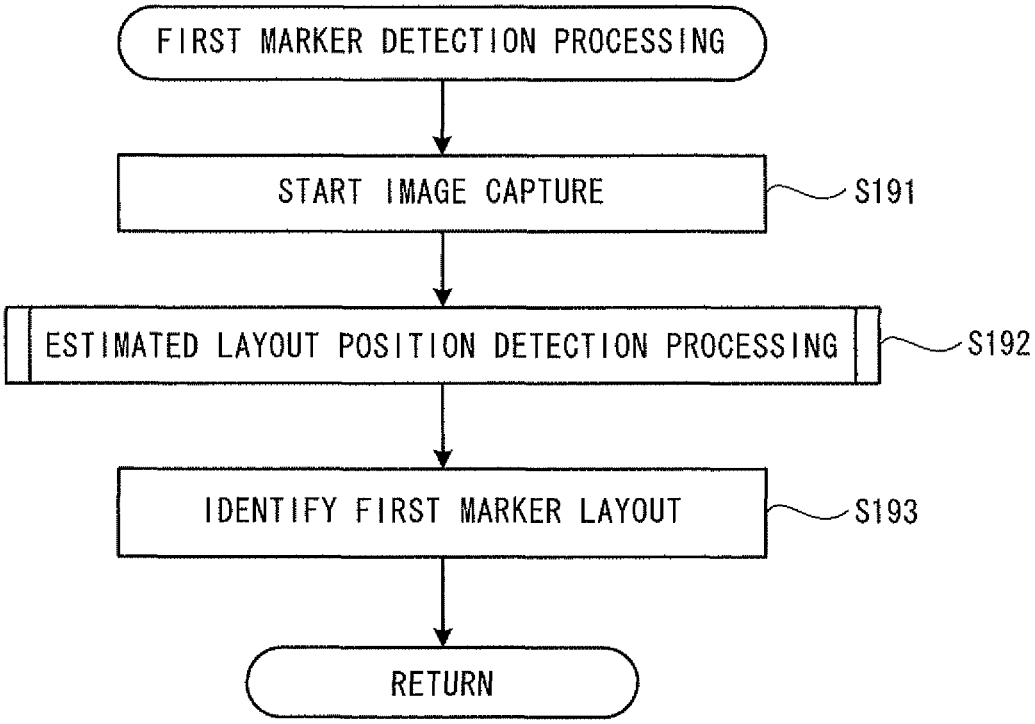
FIG. 9 is a flowchart of first marker detection processing that is performed in the main processing.

Next, first marker detection processing is performed (step S190, FIG. 9). The first marker detection processing is processing that associates the layout of the markers 110 in the first holding position with the first reference. Since the variable N is incremented by 1 at step S180, the (N−1)-th pattern corresponds to the first pattern and the N-th pattern corresponds to the second pattern. The layout of the markers 110 includes at least one of the position and the angle of the markers 110. The sewing machine 1 of the present embodiment detects, as the layout of the markers 110, the position and the angle of the markers 110 based on coordinates of the embroidery coordinate system of the first center points 111 of the two markers 110.

The position of the markers 110 is represented, for example, by the coordinates of the embroidery coordinate system 100 of the first center point 111 of one of the two markers 110. The angle of the markers 110 is represented by an angle formed by the X-axis of the embroidery coordinate system and a vector directing from the first center point 111 of the one of the two markers 110 toward the first center point 111 of the other marker 110. A distinction between the two markers 110 is determined based on, for example, a relative position of the second center point 112 with respect to the first center point 111 in each of the markers 110. Specifically, the position of the markers 110 is represented by the coordinates of the embroidery coordinate system of the first center point 111 of the one of the markers 110 (on the upper side in FIG. 11). Further, the angle of the markers 110 is represented by an angle θ formed by the X-axis and a vector 113 directing from the first center point 111 of the one of the markers 110 (on the upper side in FIG. 11) toward the first center point 111 of the other marker 110 (on the lower side in FIG. 11).

Figure 10:
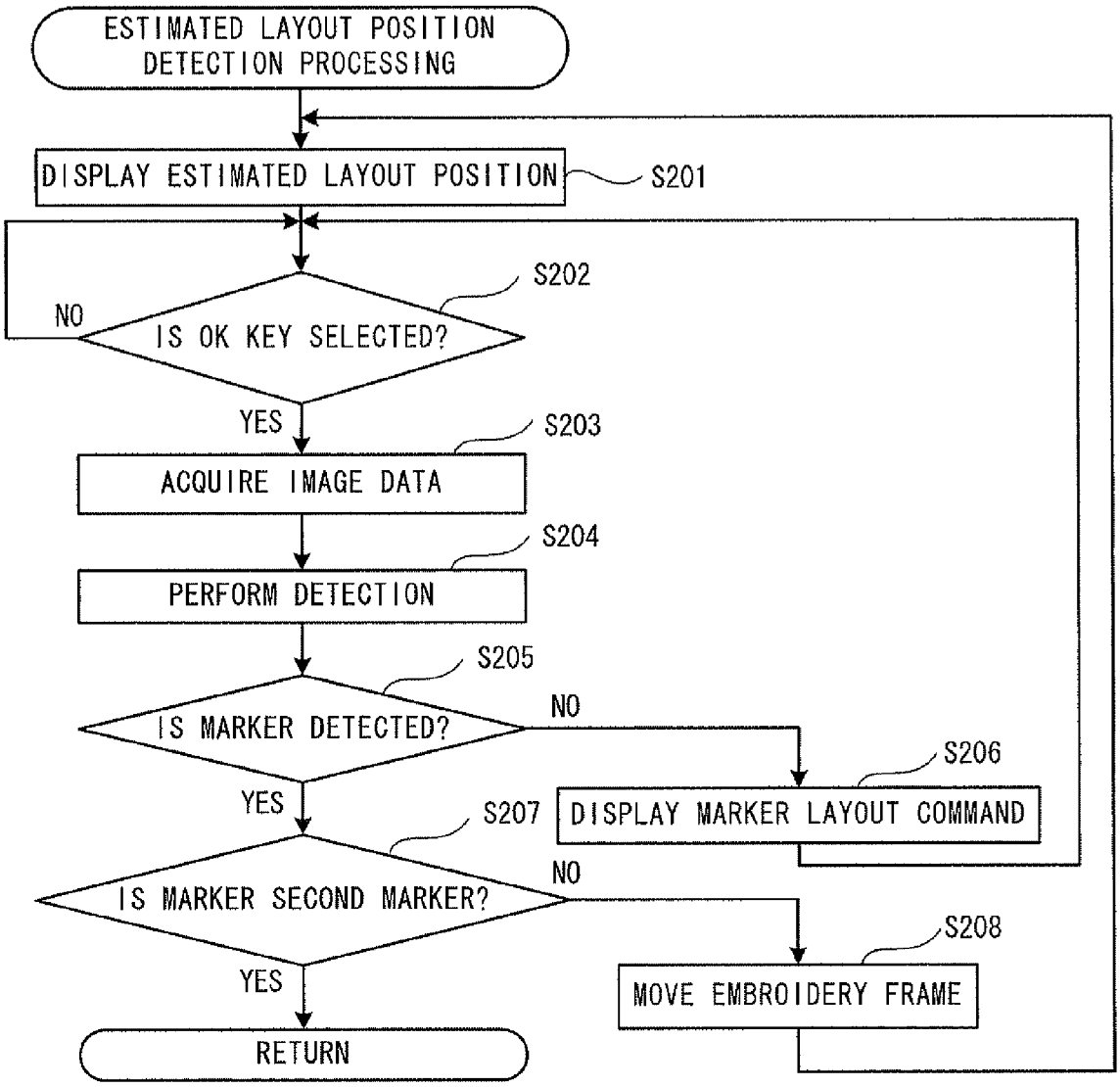
FIG. 10 is a flowchart of estimated layout position detection processing that is performed in the first marker detection processing.
Figure 11:
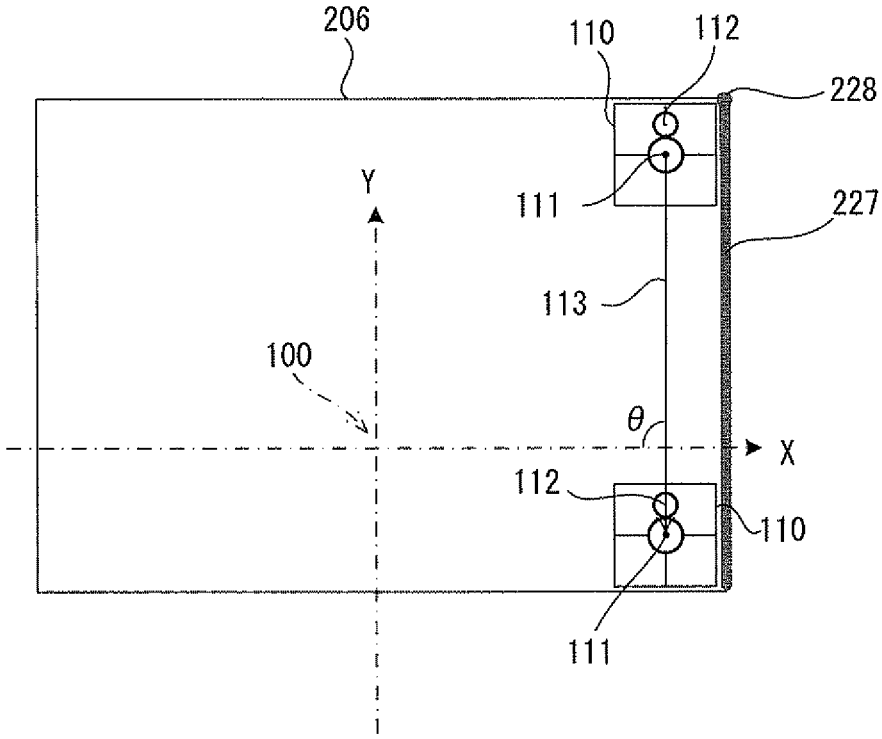
FIG. 11 is an explanatory diagram of an estimated layout position of the markers 110, with respect to a layout of a rectangle 206.
Figure 12:
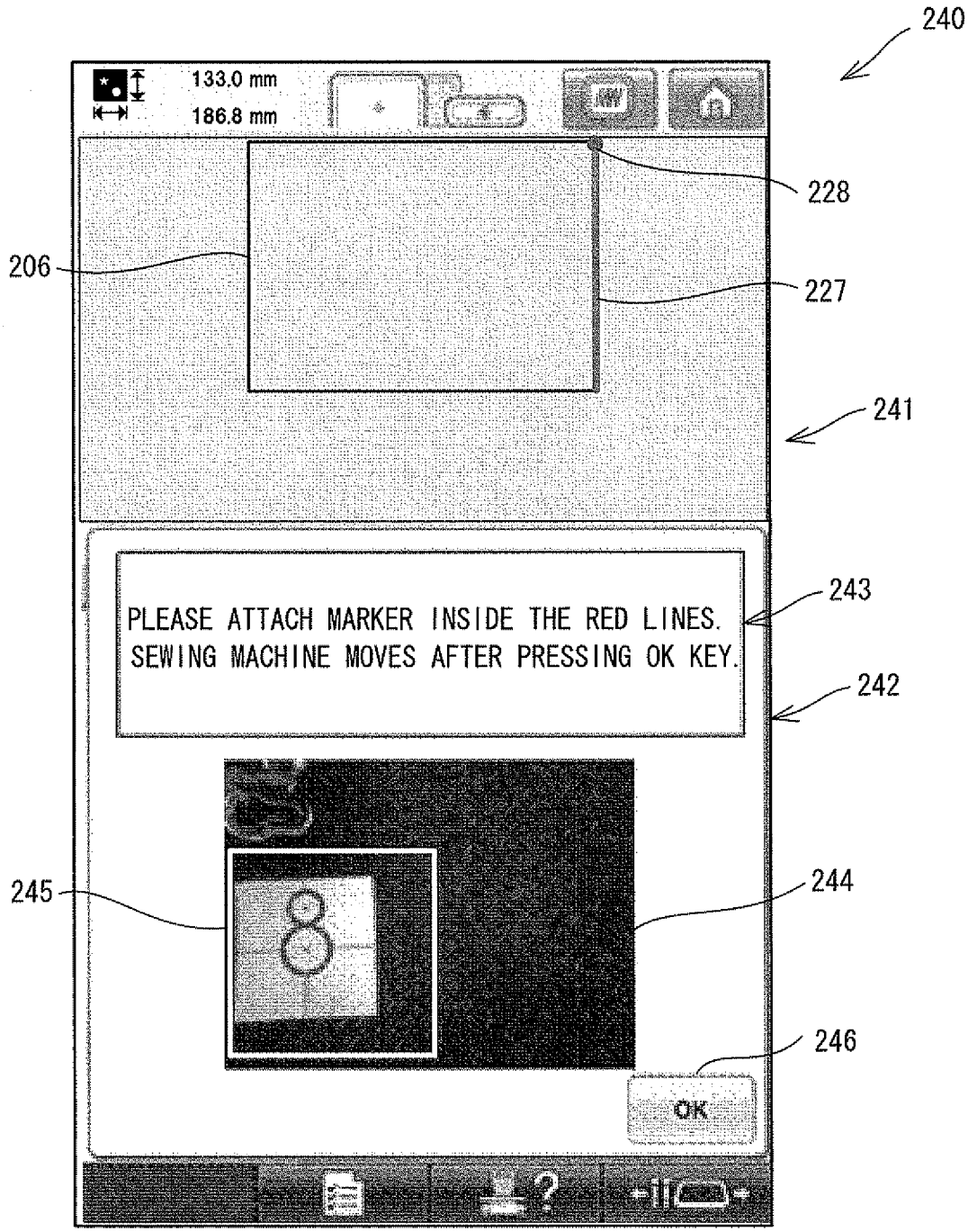
FIG. 12 is an explanatory diagram of a screen 240.

The first marker detection processing will be explained in more detail with reference to FIG. 9 and FIG. 10. First, the image sensor 50 is moved to an image capturing position and image capture of the vicinity of the needle hole 36 (refer to FIG. 1) is started by the image sensor 50 (step S191). Then, estimated layout position detection processing is performed (step S192, FIG. 10). The estimated layout position detection processing is processing that detects the markers 110 arranged in two estimated layout positions by the user. The estimated layout positions are positions in which the markers 110 on the sewing target object 39 are to be arranged respectively. In the present embodiment, as shown in FIG. 11, positions corresponding to the vicinities of the both ends of the first line segment 227 on the sewing target object 39 (refer to FIG. 2) are set as the estimated layout positions. As shown in FIG. 10, in the estimated layout position detection processing, first, the embroidery frame 84 is moved to a position that falls within an image capturing range of the image sensor 50 and the estimated layout positions are displayed on the LCD 7 (step S201). Specifically, a screen 240 exemplified in FIG. 12 is displayed on the LCD 7. A pattern display column 241 and an estimated layout position display column 242 are displayed on the screen 240. The pattern display column 241 is similar to the pattern display column 201. A message 243, a composite image 244 and an OK key 246 are displayed in the estimated layout position display column 242.

The composite image 244 is an image in which a red rectangle 245 is added to the image of the vicinity of the needle hole 36 that is output from the image sensor 50. The red rectangle 245 shows the estimated layout position. As described above, in the present embodiment, the positions corresponding to the vicinities of both the ends of the first line segment 227 are the estimated layout positions. Therefore, in the processing that detects the first marker 110, the red rectangle 245 is displayed in the vicinity of one of the ends of the first line segment 227 in the rectangle 206, in the image of the vicinity of the needle hole 36. The size of the rectangle 245 is approximately 1.5 times the size of the marker 110. The message 243 is displayed to prompt the user to select the OK key 246 after the marker 110 is arranged in an area inside the rectangle 245. While confirming the screen 240, the user attaches the marker 110 to the inside of the rectangle 245 as displayed in the estimated layout position display column 242, and after that, the user selects the OK key 246.

The CPU 61 stands by until the OK key 246 is selected (no at step S202). When the OK key 246 is selected (yes at step S202), image data output from the image sensor 50 is acquired and the acquired image data is stored in the RAM 63 (step S203). Next, processing is performed that detects the marker 110 from the image of a section inside the rectangle 245 (step S204). At step S204, when the marker 110 is detected from the image of the section inside the rectangle 245, the coordinates of the embroidery coordinate system of the first center point 111 and the second center point 112 that are included in the marker 110 are identified.

The detection of the marker 110 and the identification of the coordinates are performed using a known method. Specifically, two-dimensional coordinates in an image coordinate system, which is a coordinate system of the image captured by the image sensor 50, are calculated for the first center point 111 and the second center point 112 of the marker 110, using Hough conversion processing, for example. After that, the two-dimensional coordinates of the image coordinate system are converted to three-dimensional coordinates of the world coordinate system. As described above, in the present embodiment, the embroidery coordinate system and the world coordinate system are associated with each other. Therefore, coordinates of the embroidery coordinate system are calculated based on the three-dimensional coordinates of the world coordinate system calculated by image processing.

When the marker 110 is not detected at step S204 (no at step S205), a message that prompts the user to arrange the marker 110 in the rectangle 245 is displayed on the LCD 7 (step S206). Next, the processing returns to step S202. When the marker 110 is detected (yes at step S205), it is determined whether the detected marker 110 is the second marker 110 (step S207). As described above, the sewing machine 1 of the present embodiment detects the two markers 110 that are respectively arranged in the positions corresponding to the vicinities of both the ends of the first line segment 227 on the sewing target object 39, and associates the layout of the markers 110 with the layout of the first reference in the first holding position. Therefore, when the detected marker 110 is the first marker 110 (no at step S207), the control signal is output to the drive circuits 131 and 133 and the embroidery frame 84 is moved to a position to detect the second marker 110 (step S208). Specifically, the embroidery frame 84 is moved to a position where the estimated layout position that is set in the vicinity of the end (which is opposite the end of the first line segment 227 used in the processing for the first marker 110) falls within the image capturing range of the image sensor 50.

Next, the processing returns to step S201 and processing to detect the second marker 110 is performed (step S201 to step S206). Note that, at step S201 of the processing for the second marker 110, the red rectangle 245 is displayed inside the rectangle indicating the range in which the first pattern is sewn. More precisely, the red rectangle 245 is displayed in the vicinity of the end that is opposite the end of the first line segment 227 displayed in the processing for the first marker 110. When the detected marker 110 is the second marker 110 (yes at step S207), the CPU 61 ends the estimated layout position detection processing and the processing returns to the first marker detection processing. The layout of the markers 110 with respect to the first reference in the first holding position is identified based on embroidery coordinates of the markers 110 detected in the estimated layout position detection processing (step S192) and on embroidery coordinates of the first reference. The identified layout of the markers 110 is stored in the RAM 63 as a first marker layout (step S193). Specifically, the embroidery coordinates of the first center points 111 (refer to FIG. 11) of the markers 110 in the first holding position are associated with the coordinates of the first reference (the first line segment 227 and the first point 228) in the first holding position identified at step S120 of the main processing. Thus, the layout (the position and the angle) of the markers 110 with respect to the first reference in the first holding position is identified. After that, the CPU 61 ends the first marker detection processing and the processing returns to the main processing.

Subsequent to the first marker detection processing (step S190), the CPU 61 causes the LCD 7 to display a message that prompts the user to change the holding position of the sewing target object 39 (refer to FIG. 2) with respect to the embroidery frame 84, and an OK key (not shown in the drawings) (step S210). After this message is displayed, the user changes the holding position of the sewing target object 39 with respect to the embroidery frame 84, in a state in which the markers 110 are attached to the surface of the sewing target object 39. In other words, even if the holding position is changed, the layout of the markers 110 with respect to the sewing target object 39 is not changed. The changed holding position is different from the first holding position, in terms of a relative holding position of the sewing target object 39 with respect to the embroidery frame 84.

The changed holding position needs to satisfy at least a condition that each of the two markers 110 attached to the sewing target object 39 is located inside the embroidery frame 84, particularly, inside the sewable area 86 in the changed holding position. In addition to this condition, when the next pattern that is arranged in accordance with a command from the user falls within the sewable area 86 in the changed holding position, the changed holding position is the second holding position. In this case, sewing is performed after the layout of the next pattern (the second pattern) with respect to the sewing target object 39 has been set, with the holding position being the second holding position. On the other hand, in the changed holding position, it may not be possible to perform sewing because the next pattern to be arranged may not fall within the sewable area 86 in the changed holding position. In this case, the changed holding position is taken as a temporary holding position, and the layout of the markers 110 with respect to the first reference in the temporary holding position is identified. After that, the holding position is changed to the second holding position.

Figure 13:
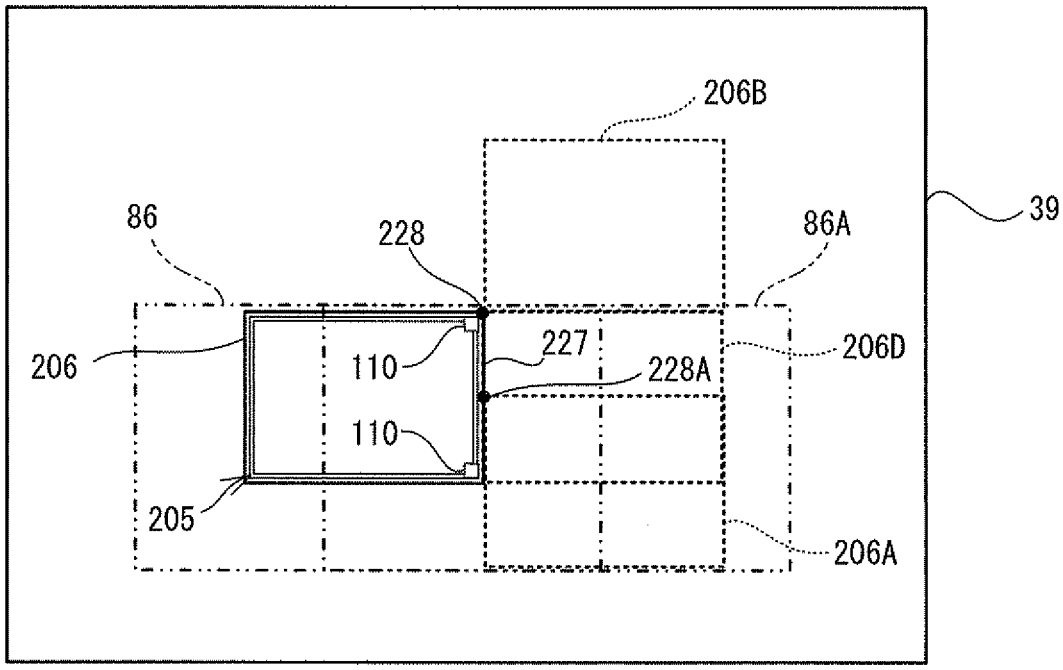
FIG. 13 is an explanatory diagram illustrating transition states of a holding position of a sewing target object 39 and a layout of the markers 110.

For example, as shown in FIG. 13, the pattern 205, which is the first pattern, is sewn in the rectangle 206 that is arranged inside the sewable area 86 in the first holding position. After that, the layout of the two markers 110 attached to the vicinities of both the ends of the right side (which is specified as the first line segment 227) of the rectangle 206 is identified. In accordance with the message that prompts the user to change the holding position, the user temporarily removes the sewing target object 39 from the embroidery frame 84, and sets the sewing target object 39 on the embroidery frame 84 so that the two markers 110 are arranged, for example, inside a sewable area 86A that is set in the changed holding position. When the user wants to arrange the second pattern in a rectangle 206A, the second pattern falls within the sewable area 86A. Therefore, the changed holding position is the second holding position. On the other hand, when the user wants to arrange the next pattern in a rectangle 206B, the next pattern does not fall within the sewable area 86A. Therefore, the changed holding position is the temporary holding position. Processing that is performed after the holding position is changed to the second holding position or to the temporary holding position will be described in detail later.

When the holding position is changed and the OK key is selected, the processing returns to step S20. As shown in FIG. 13, it is assumed that, after the first pattern 205 has been sewn as the first pattern, the same pattern 205 is selected as the second pattern (yes at step S20). In this case, after sewing data of the second pattern 205 has been acquired (step S30), it is determined that the variable N is not 1 (no at step S40). When the variable N is two or more, layout setting processing is performed (step S60, FIG. 14). In the layout setting processing, processing that sets the layout of the N-th pattern (the second pattern) with respect to the sewing target object 39 in the second holding position is performed. As described above, at a point in time at which the layout setting processing is performed, the first pattern has already been sewn on the sewing target object 39 and the layout with respect to the sewing target object 39 has been ascertained.

Figure 14:
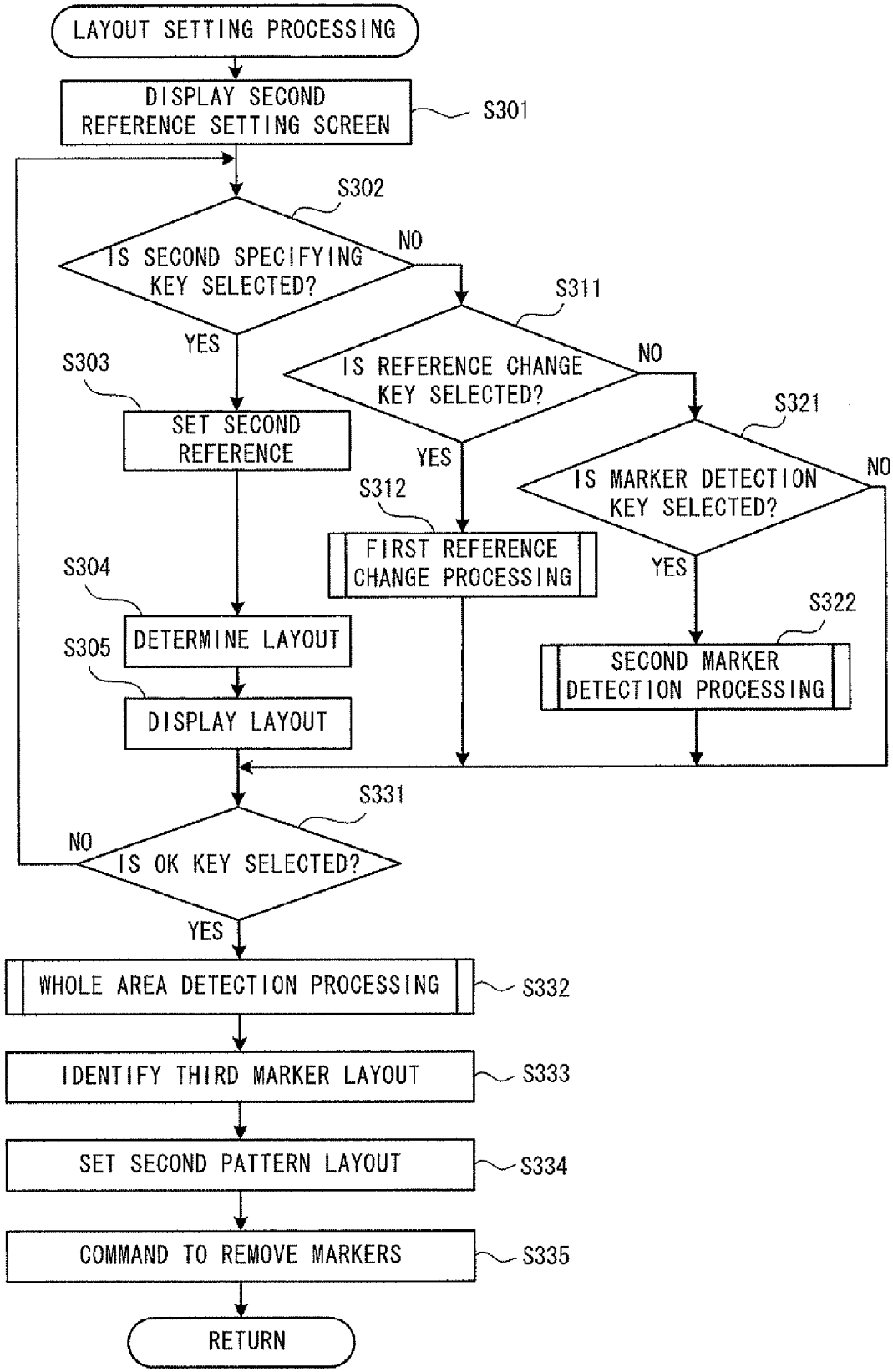
FIG. 14 is a flowchart of layout setting processing according to a first embodiment.
Figure 15:
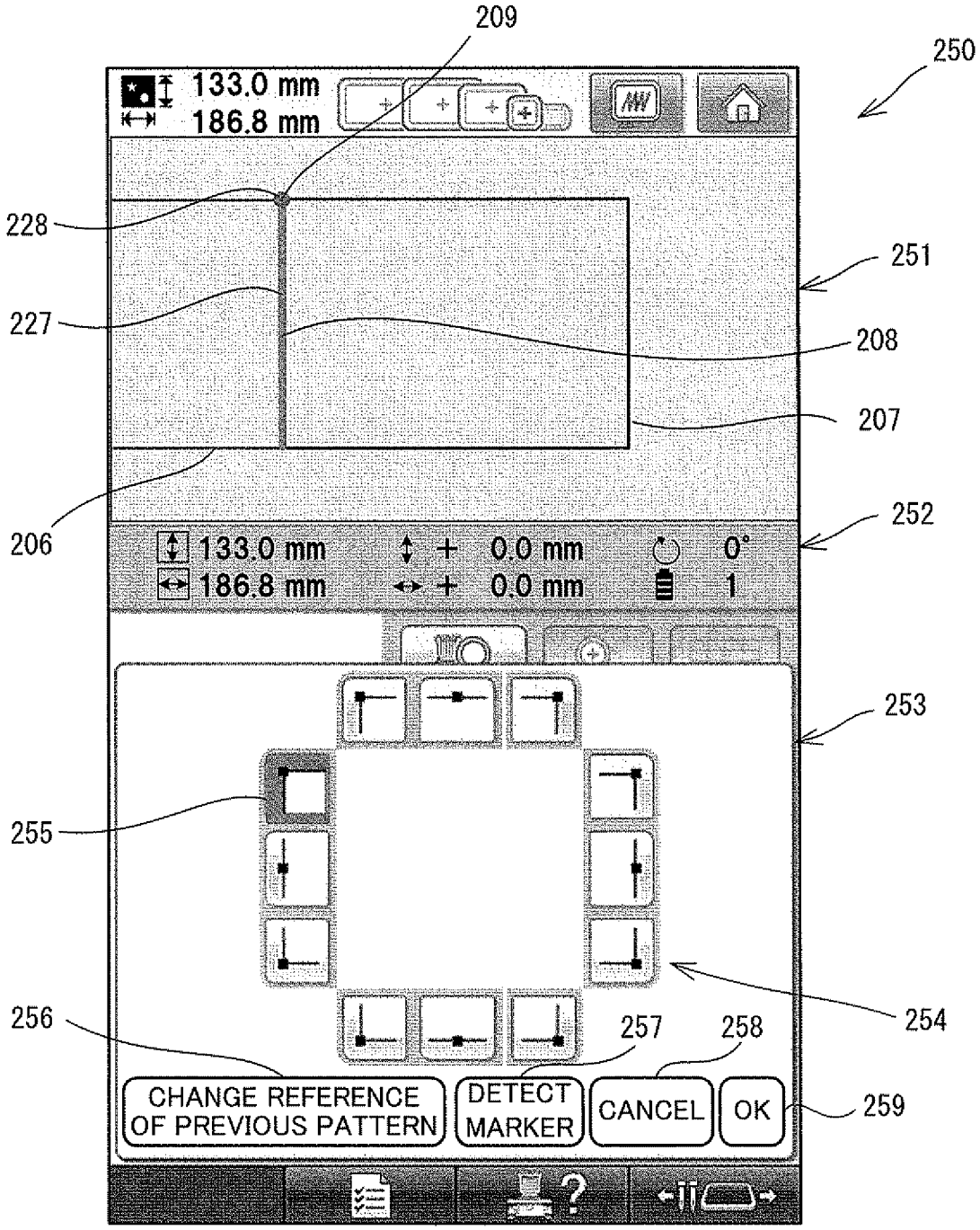
FIG. 15 is an explanatory diagram of a second reference setting screen 250.

The layout setting processing will be explained in more detail with reference to FIG. 14 to FIG. 20. As shown in FIG. 14, in the layout setting processing, first, a second reference setting screen 250 shown in FIG. 15 is displayed (step S301). A pattern display column 251, a pattern information column 252 and a command key display column 253 are displayed on the second reference setting screen 250. The pattern display column 251 is similar to the pattern display column 201. The pattern information column 252 is similar to the pattern information column 202. A group of second specifying keys 254, a previous pattern reference change key (hereinafter referred to as a reference change key) 256, a marker detection key 257, a cancel key 258 and an OK key 259 are displayed in the command key display column 253. Each of second specifying keys included in the group of second specifying keys 254 is a key to specify a second reference. The second reference is a reference with respect to the second pattern, and the second reference is used when the layout of the second pattern (the N-th pattern) with respect to the layout of the first pattern (the (N−1)-th pattern) is determined.

The second reference is, for example, a reference including at least one of a second line segment 208 and a second point 209 that are included in a second graphic, and the second reference is specified by the user. The second reference of the present embodiment includes the second line segment 208 and the second point 209. The second graphic is a graphic representing a range in which the second pattern to be sewn next is sewn. In the present embodiment, similarly to the first graphic, the second graphic is the smallest rectangle in which the second pattern can be arranged. Similarly to the first line segment 227 (refer to FIG. 8), the second line segment 208 is selected from among four sides of the smallest rectangle. Similarly to the first point 228 (refer to FIG. 8), the second point 209 is selected from among both end points of the second line segment 208 and a midpoint of the second line segment 208. In the present embodiment, a combination of the second line segment 208 and the second point 209 is selected as the second reference, from among the twelve second specifying keys included in the group of second specifying keys 254.

The reference change key 256 is a key that is selected when the user wants to change the first reference that has already been set. For example, it is selected in a case such as when the user notices that the first reference has been erroneously set when the second reference is specified or after the second reference has been specified. The processing that changes the first reference will be described later. In a case where the current holding position is the above-described temporary holding position, the marker detection key 257 is selected when the layout of the markers 110 with respect to the first reference is identified in the temporary holding position. The processing that identifies the layout of the markers 110 in the temporary holding position will be described later. The cancel key 258 is a key to cancel specification of the second reference before the specification of the second reference is completed. The OK key 259 is selected when the specification of the second reference is completed.

It is determined whether one of the second specifying keys is selected from among the group of second specifying keys 254 (step S302). When one of the second specifying keys is selected (yes at step S302), the second reference specified by the second specifying key is set and stored in the RAM 63 (step S303). More specifically, based on the embroidery data, the layout of the second reference (the second line segment and the second point) is identified by the coordinates of the embroidery coordinate system, and the identified layout of the second reference is stored in the RAM 63. Based on the first reference and the second reference, a relative layout of the second pattern with respect to the layout of the first pattern is determined, and the determined layout is stored in the RAM 63 (step S304). The determined layout of the second pattern with respect to the first pattern is displayed on the LCD 7 (step S305).

In the present embodiment, the layout of a pattern includes the position and angle of the pattern with respect to the initial layout. A relative layout of the second pattern (the N-th pattern) with respect to the layout of the first pattern (the (N−1)-th pattern) is determined based on the first reference and the second reference in the following manner. That is, the relative layout of the second pattern with respect to the layout of the first pattern is determined to be a layout in which an extending direction of the first line segment 227 overlaps with the second line segment 208 and the first point 228 overlaps with the second point 209. Two types of layout that meet the above-described condition are conceivable as the relative layout of the second pattern with respect to the layout of the first pattern. The two types of layout are a layout in which the first pattern and the second pattern overlap with each other, and a layout in which the first pattern and the second pattern do not overlap with each other. Of the two types of layout, the present embodiment adopts the layout in which the first pattern and the second pattern do not overlap with each other.

For example, in a state in which the first reference (the first line segment 227 and the first point 228) of the first pattern 205 (refer to FIG. 6) is set as shown in FIG. 8, it is assumed that a second specifying key 255 is selected on the second reference setting screen 250. The second specifying key 255 is used to specify a combination of the left side of a rectangle 207 representing a range of the second pattern 205 and the upper end point of the left side. In this case, a relative layout of the second pattern 205 with respect to the layout of the first pattern 205 is determined in the following manner and is displayed on the pattern display column 251. The relative layout is determined to be a layout in which the extending direction of the right side (the first line segment 227) of the rectangle 206 representing a range of the first pattern 205 overlaps with the left side (the second line segment 208) of the rectangle 207, and in which the upper end point (the first point 228) of the right side of the rectangle 206 overlaps with the upper end point (the second point 209) of the left side of the rectangle 207. By looking at the screen displayed on the LCD 7, the user can confirm the relative layout of the second pattern (the N-th pattern) with respect to the layout of the first pattern (the (N−1)-th pattern). If the layout relationship is as desired by the user, the user selects the OK key 259 (yes at step S331). In this case, the processing proceeds to step S332, which will be described later.

On the other hand, there may be a case in which, as a result of confirming the layout relationship between the first pattern and the second pattern displayed at step S305, the user notices that the first reference of the first pattern has been erroneously set. In this type of case, the user does not select the OK key 259 and the second specifying key (no at step S331, no at step S302), but selects the reference change key 256 to issue a command to change the first reference that has already been set (yes at step S311). Further, there may be a case in which, before setting the second reference, the user wants to change the first reference of the first pattern. In this type of case, the user does not select the second specifying key in the first place, but selects the reference change key 256 (step S301, no at step S302, yes at step S311). When the reference change key 256 is selected (yes at step S311), first reference change processing is performed (step S312, FIG. 16). The first reference change processing is processing that changes the first reference that has already been set, and identifies the layout of the markers 110 with respect to the changed first reference in the first holding position.

Figure 16:
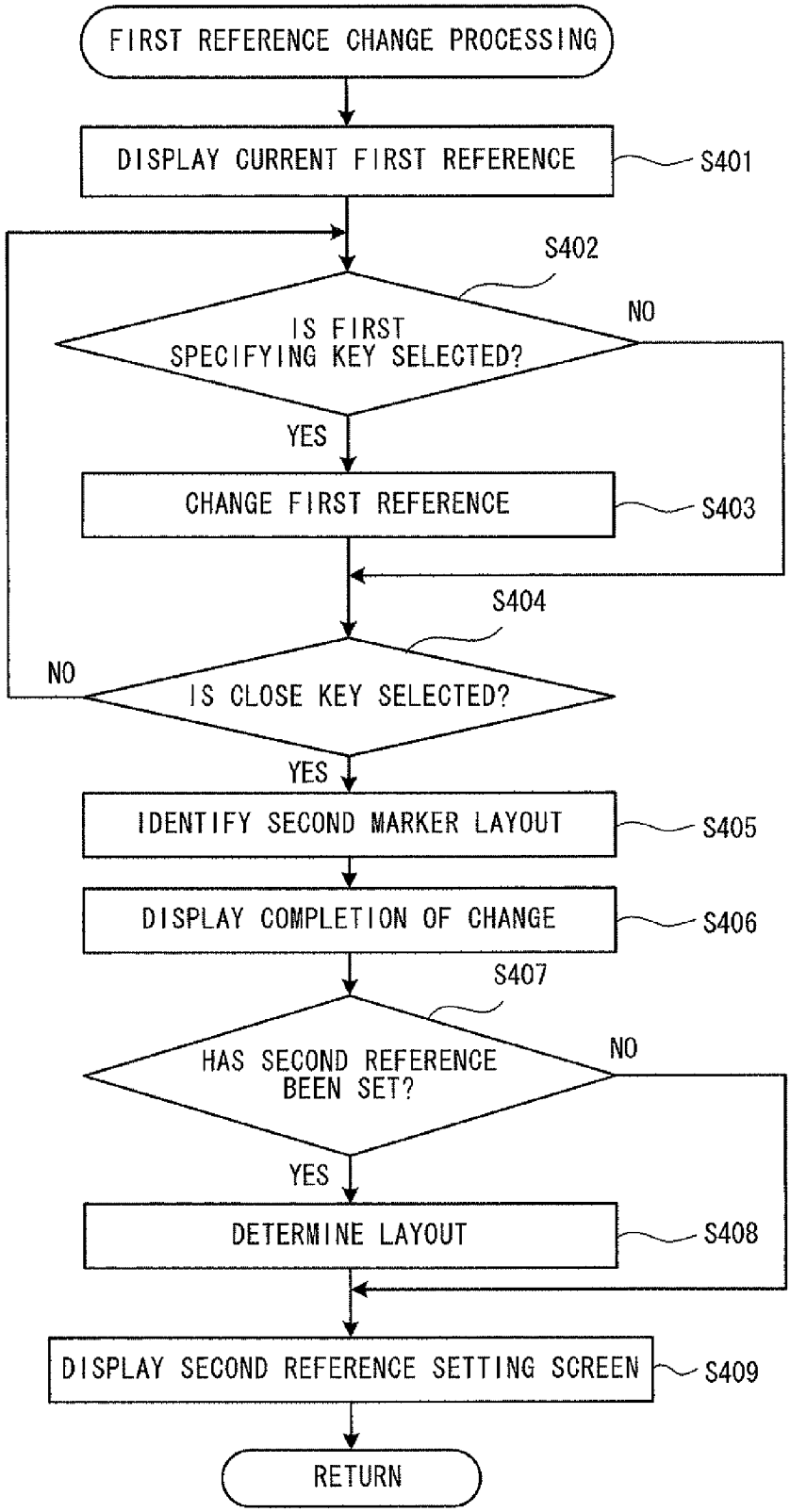
FIG. 16 is a flowchart of first reference change processing that is performed in the layout setting processing.
Figure 17:
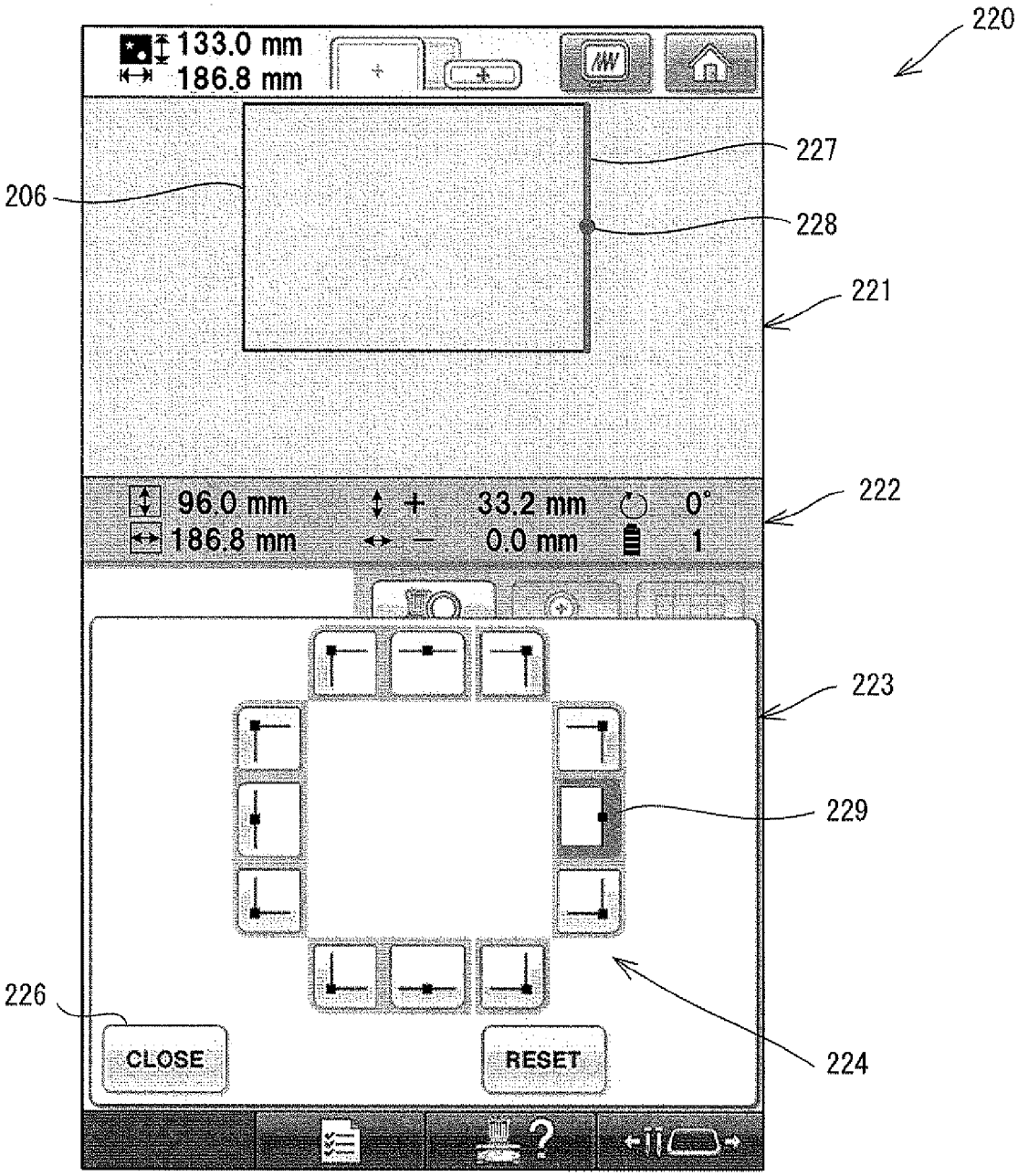
FIG. 17 is an explanatory diagram of the first reference setting screen 220 when changing a first reference.

The first reference change processing will be explained with reference to FIG. 16 and FIG. 17, using a specific example in which the first reference (the first line segment 227 and the first point 228) of the first pattern 205 is set as shown in FIG. 13. As shown in FIG. 16, first, the current first reference is displayed on the LCD 7 (step S401). Specifically, the first reference setting screen 220 (refer to FIG. 8) is displayed again. As described above, the layout of the first reference (the first line segment 227 and the first point 228) is set at step S120 of the main processing and is stored in the RAM 63. Therefore, based on the layout of the first reference stored in the RAM 63, the rectangle 206, to which the set first line segment 227 and the set first point 228 are added, is displayed in the pattern display column 221. The first specifying key corresponding to the combination of the set first line segment 227 and the set first point 228 is displayed in the command key display column 223 such that the user can recognize it.

When one of the first specifying keys is selected from among the group of first specifying keys 224 (yes at step S402), the first reference stored in the RAM 63 is changed to the first reference that corresponds to the newly selected first specifying key, and the changed first reference is stored in the RAM 63 (step S403). Specifically, the layout of the changed first reference (the first line segment 227 and the first point 228) in the rectangle that corresponds to the first pattern is identified by the coordinates of the embroidery coordinate system based on the sewing data of the first pattern, and the identified layout is stored in the RAM 63. Further, at step S403, the rectangle 206, to which the changed first reference is added, is displayed in the pattern display column 221.

As shown in FIG. 13, when the user wants to arrange the second pattern in the rectangle 206A, the second pattern cannot be connected to the first point 228 before the change, as the user desires. Therefore, the user needs to change the first point 228 to the position of a midpoint 228A of the right side of the rectangle 206, for example. In this case, as shown in FIG. 17, the user selects a first specifying key 229 that corresponds to a combination of the right side of the rectangle 206 and the midpoint of the right side. In response to this, the coordinates stored in the RAM 63, which identify the right side of the rectangle 206 and the upper end point of the right side, are changed to the coordinates that identify the right side of the rectangle 206 and the midpoint of the right side. Further, the rectangle 206 is displayed in the pattern display column 221 such that the first line segment 227 is added to the right side of the rectangle 206 and the first point 228 is added to the midpoint of the right side.

When none of the first specifying keys is selected from among the group of first specifying keys 224 (no at step S402), or after the first reference has been changed at step S403, it is determined whether the CLOSE key 226 has been selected (step S404). When the CLOSE key 226 has not been selected (no at step S404), the processing returns to step S402. When the CLOSE key 226 has been selected (yes at step S404), the layout of the markers 110 with respect to the changed first reference in the first holding position is identified as a second marker layout. Then, the first marker layout stored in the RAM 63 is updated to the second marker layout (step S405). Specifically, the coordinates of the embroidery coordinate system of the changed first line segment 227 and the changed first point 228 in the first holding position can be identified from the sewing data of the pattern 205 that corresponds to the rectangle 206. Note that, in a case where the pattern is edited at step S50 of the main processing shown in FIG. 5 and the sewing data is corrected, the coordinates of the embroidery coordinate system of the changed first line segment 227 and the changed first point 228 in the first holding position can be identified from the corrected sewing data. The layout of the markers 110 with respect to the changed first reference in the first holding position is identified based on the identified coordinates of the changed first line segment 227 and the changed first point 228, and on the coordinates of the markers 110 in the first holding position that are stored in the RAM 63.

The CPU 61 causes the LCD 7 to display a screen (not shown in the drawings) including a message that notifies that the change of the first reference is completed (step S406). Next, it is determined whether the second reference has already been set (step S407). When the second reference has already been set (yes at step S407), as described above, the relative layout of the second pattern with respect to the first pattern has been determined based on the first reference before the change and the second reference (step S304 in FIG. 14). Therefore, based on the changed first reference and the second reference, the relative layout of the second pattern with respect to the first pattern is determined again (step S408). A method for determining the layout is the same as at step S304 in FIG. 14.

After that, the CPU 61 causes the LCD 7 to display the second reference setting screen 250 again (step S409). At this time, two rectangles corresponding to the first pattern and the second pattern are displayed in the pattern display column 251, based on the layout relationship that has been determined again. On the other hand, when the second reference has not yet been set at the time of the completion of the change of the first reference (no at step S407), the second reference setting screen 250 is displayed in the pattern display column 251 in a state in which the rectangle corresponding to the second pattern only is displayed (step S409). After step S409, the CPU 61 ends the first reference change processing, and the processing returns to the layout setting processing. Note that, if the user has not yet set the second reference, one of the second specifying keys is subsequently selected and the second reference is set (yes at step S5302, step S303). In this case, at the subsequent step S304, the relative layout of the second pattern with respect to the first pattern is determined based on the changed first reference and the second reference.

When neither the second specifying key nor the reference change key 256 is selected on the second reference setting screen 250 (no at step S302, no at step S311), it is determined whether the marker detection key 257 has been selected and the execution of second marker detection processing has been commanded (step S321). When the marker detection key 257 has not been selected (no at step S321), the processing proceeds to step S331. On the other hand, for example, when the user wants to arrange the second pattern in the position of the rectangle 206B as shown in FIG. 13, the second pattern does not fall within the sewable area 86A that is set in the holding position at this point in time. In this type of case, the user selects the marker detection key 257 (yes at step S321). In this case, the second marker detection processing is performed (step S322, FIG. 18).

Figure 19:
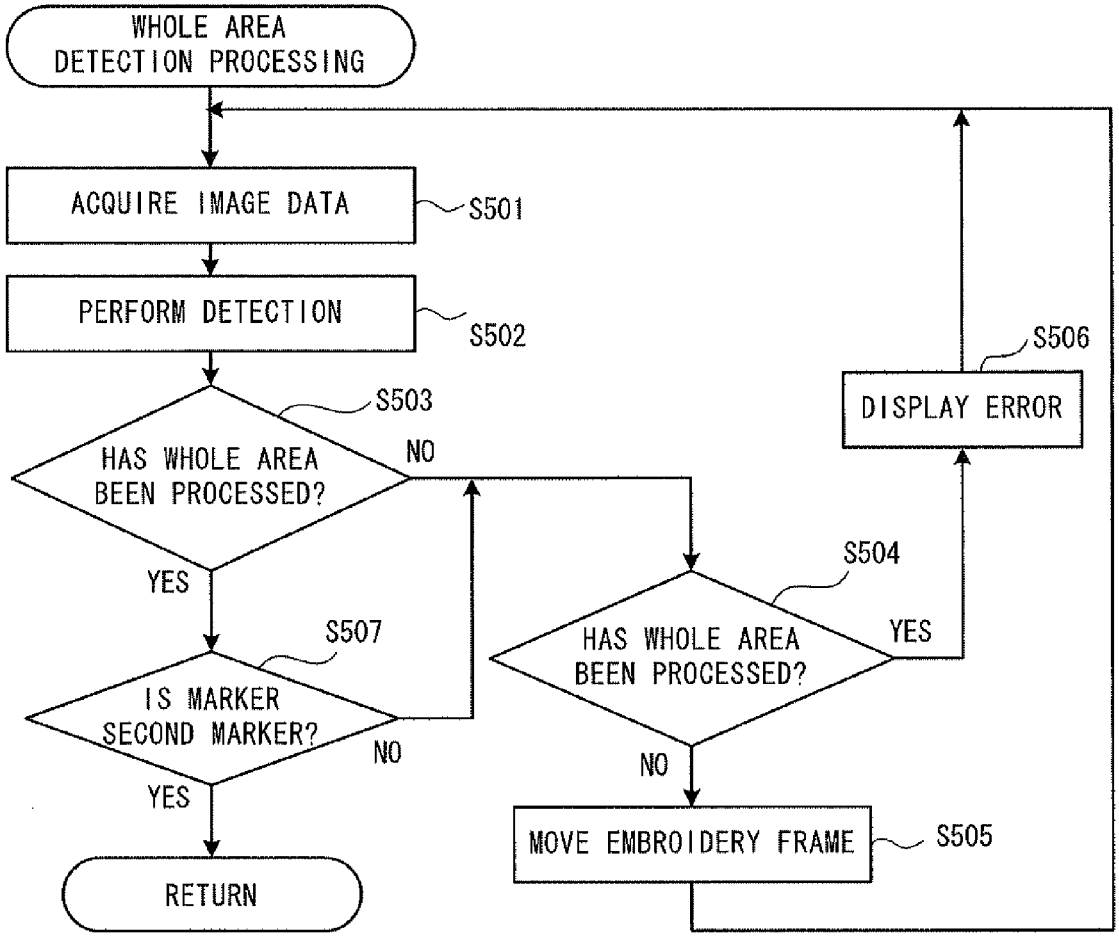
FIG. 19 is a flowchart of whole area detection processing that is performed in the layout setting processing and in the second marker detection processing.
Figure 20:
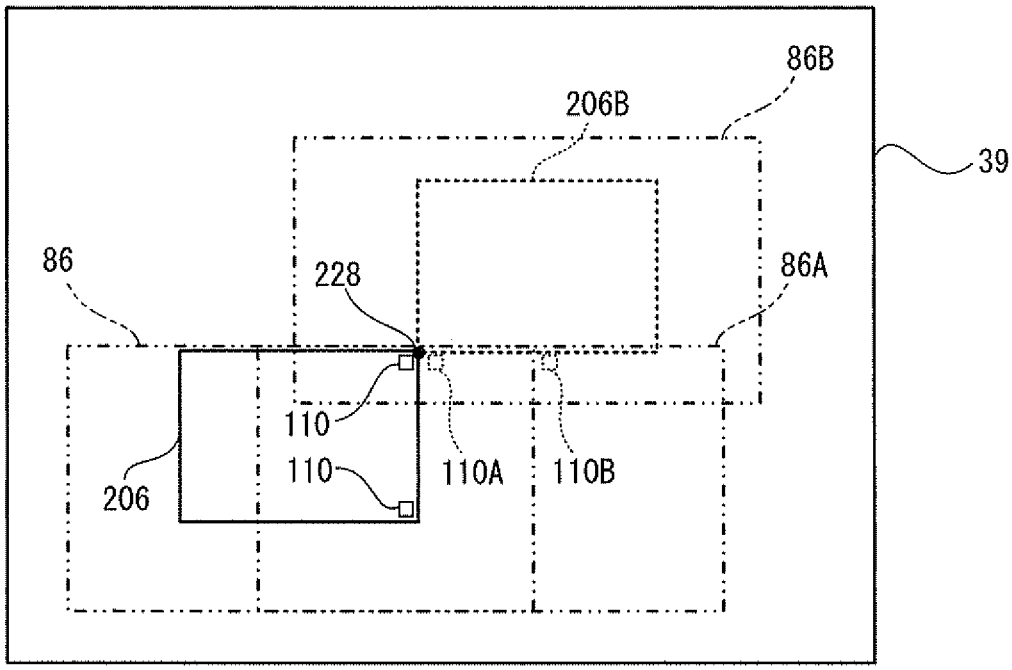
FIG. 20 is another explanatory diagram illustrating transition states of the holding position of the sewing target object 39 and the layout of the markers 110.

The second marker detection processing will be explained with reference to FIG. 18 to FIG. 20, using an example in which the following processing is performed. As shown in FIG. 20, first, the first pattern is sewn in the rectangle 206 in a state in which the holding position of the sewing target object 39 with respect to the embroidery frame 84 (refer to FIG. 2) is in the first holding position corresponding to the sewable area 86. Here, the right side of the rectangle 206 is specified as the first line segment 227 and the upper end point of the right side is specified as the first point 228. After that, the holding position is changed to the temporary holding position that corresponds to the sewable area 86A, and the second marker detection processing is performed. In the second marker detection processing, detection processing of the marker 110 is performed twice, once before and once after re-attaching the markers 110, and the layout of the markers 110 with respect to the first reference is updated.

Figure 18:
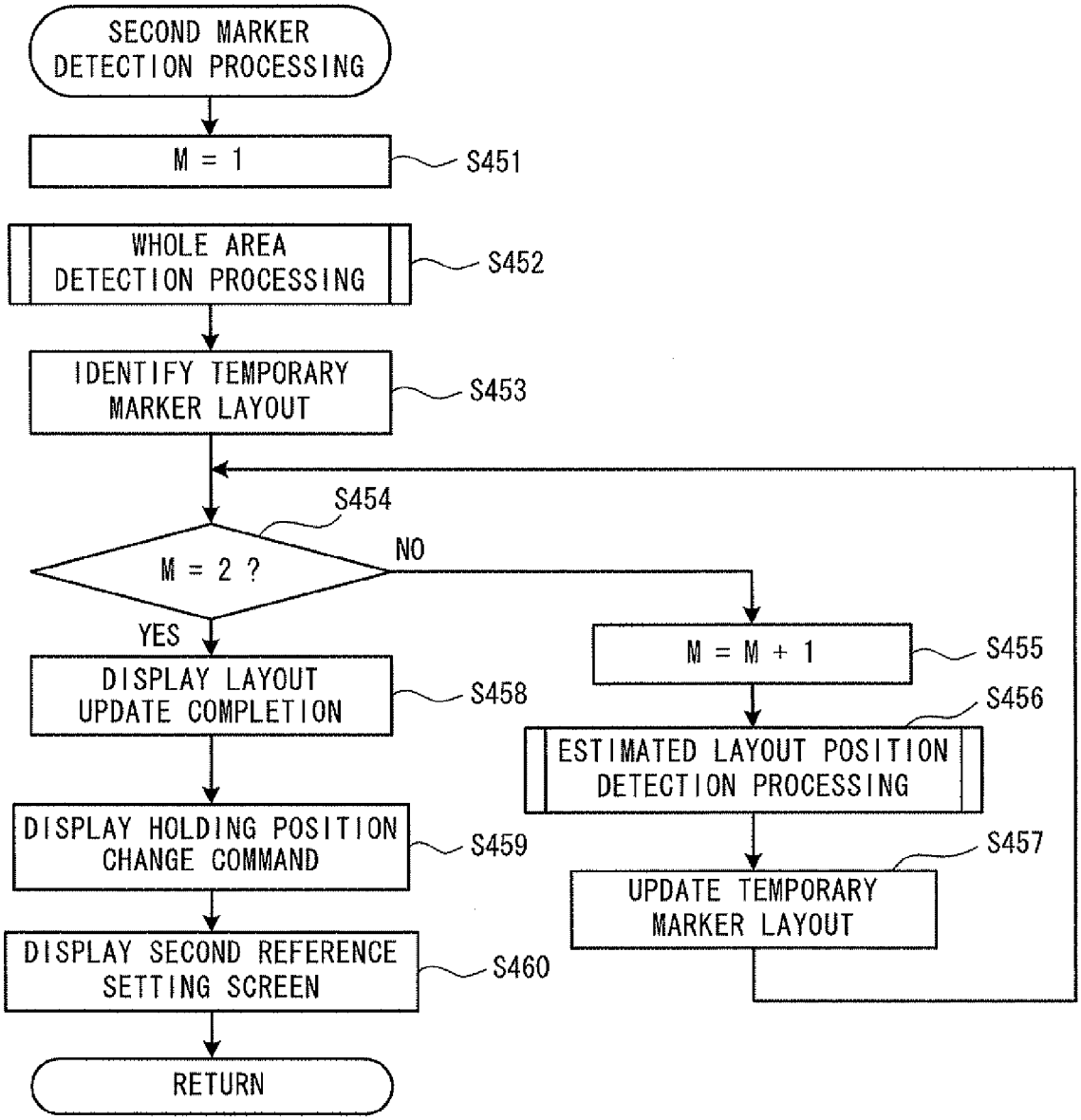
FIG. 18 is a flowchart of second marker detection processing that is performed in the layout setting processing.

As shown in FIG. 18, in the second marker detection processing, first, a variable M that indicates the number of detections of the marker 110 is set to 1, and the set variable M is stored in the RAM 63 (step S451). Then, whole area detection processing, which is first-time detection processing, is performed (step S452, FIG. 19). In the whole area detection processing, the whole area inside the embroidery frame 84 (refer to FIG. 2) is taken as an image capturing target until the marker 110 is detected, unlike the estimated layout position detection processing (refer to FIG. 10) in which the estimated layout position only is taken as the image capturing target. As shown in FIG. 19, image data output from the image sensor 50 is acquired (step S501), and detection processing of the marker 110 is performed taking the whole image represented by the acquired image data as a detection target (step S502). The detection of the marker 110 is performed using a known method, in a similar way to that at step S204 of the estimated layout position detection processing shown in FIG. 10. When the marker 110 is detected, coordinates of the embroidery coordinate system of the first center point 111 and the second center point 112 of the marker 110 are calculated, for example.

When the marker 110 is not detected (no at step S503), the whole area inside the embroidery frame 84 is set as a detection target range and it is determined whether the processing is completed (step S504). When there is an area that has not been set as the detection target range (no at step S504), the control signal is output to the drive circuits 131 and 133, and the embroidery frame 84 is moved to a position where the area that has not been set as the detection target range falls within the image capturing range of the image sensor 50 (step S505). The processing returns to step S501 and processing that detects the marker 110 from the image is performed. When the inside area of the embroidery frame 84 is sequentially processed in this way and the processing is completed for the whole area without detecting the marker 110 (yes at step S504), an error message informing that the two markers 110 cannot be detected is displayed on the LCD 7 (step S506). In this case, the user confirms whether the two markers 110 are located in the inside area of the embroidery frame 84. The processing returns to step S501 and the processing that detects the marker 110 from the image is performed.

When the marker 110 is detected (yes at step S503), it is determined whether the detected marker 110 is the second marker 110 (step S507). When the detected marker 110 is not the second marker 110 (no at step S507), the processing proceeds to step S504. Then, as described above, until the marker 110 is detected, the image is acquired in the inside area of the embroidery frame 84 by moving the embroidery frame 84, and processing that detects the second marker 110 is performed. When this processing is repeated and the second marker 110 is detected (yes at step S507), the CPU 61 ends the whole area detection processing, and the processing returns to the second marker detection processing. The layout of the markers 110 with respect to the first reference in the temporary holding position is identified and the identified layout is stored in the RAM 63 as a temporary marker layout (step S453). Note that, at step S453, the first marker layout or the second marker layout that have already been stored in the RAM 63, or the temporary marker layout stored by the second marker detection processing performed in the past is updated to the newly identified temporary marker layout.

For example, the layout of the markers 110 with respect to the first reference in the first holding position that corresponds to the sewable area 86 shown in FIG. 20 has already been identified. Further, if the holding position of the sewing target object 39 is changed to the temporary holding position that corresponds to the sewable area 86A, the embroidery coordinate system in the temporary holding position is set and the origin is known. In the whole area detection processing, the coordinates of the markers 110 in the temporary holding position are identified. If the embroidery coordinates of the first reference (the first line segment 227 and the first point 228) in the first holding position are converted to the coordinates of the embroidery coordinate system in the temporary holding position, the coordinates of the first reference in the temporary holding position can be associated with the markers 110. In other words, the layout (including the position and angle) of the markers 110 with respect to the first reference in the temporary holding position that corresponds to the sewable area 86A is identified.

Next, it is determined whether a value of the variable M is 2, namely, whether the detection processing has already been performed twice (step S454). When the value of the variable M is not 2 (no at step S454), the variable M is incremented by 1 (step S455), and the estimated layout position detection processing, which is second-time detection processing of the marker 110, is performed (step S456). Content of the estimated layout position detection processing performed at step S456 is substantially the same as the content of the estimated layout position detection processing that is performed in the first marker detection processing (refer to FIG. 10). Therefore, here, only the content of the processing that is different from that performed in the first marker detection processing will be explained.

As shown in FIG. 10, the red rectangle 245 that shows the estimated layout position of one of the markers 110 is displayed on the screen 240 (refer to FIG. 12) (step S201). The estimated layout position in this case may be determined, for example, in accordance with the first reference. For example, as shown in FIG. 20, when the first line segment 227 of the first reference is the right side of the rectangle 206 and the first point 228 is the upper end point of the right side, there is a high possibility that the user wants to arrange the second pattern in an area above and to the right of the first pattern. Therefore, the estimated layout position is set such that, for example, a first estimated layout position 110A is set immediately to the right side of the first point 228 inside the sewable area 86A, and a second estimated layout position 110B is set in a position that is separated from the first estimated layout position 110A to the right along the upper side of the rectangle 206. Subsequent processing from step S202 to step S208 has the same content as that performed in the first marker detection processing (refer to FIG. 9), and an explanation thereof is thus omitted.

When the detection of the second marker 110 is also completed in this way (yes at step S207), the CPU 61 ends the estimated layout position detection processing, and the processing returns to the second marker detection processing. Then, the layout of the re-attached markers 110 with respect to the first reference in the temporary holding position is identified, and the temporary marker layout that has already been stored in the RAM 63 is updated to the identified layout (step S457). For example, the layout of the markers 110 before the reattachment with respect to the first reference in the temporary holding position that corresponds to the sewable area 86A shown in FIG. 20, and the embroidery coordinates of the markers 110 before the reattachment have already been identified. Therefore, based on these pieces of information and on the embroidery coordinates of the markers 110 that have been re-attached to the first estimated layout position 110A and the second estimated layout position 110B, it is possible to identify the layout (including the position and angle) of the re-attached markers 110 with respect to the first reference in the temporary holding position.

After the temporary marker layout has been updated, the processing returns to step S454. Since the second-time detection processing ends and the variable M has been set to 2 (yes at step S454), a message indicating that the layout of the markers 110 with respect to the first reference is updated and an OK key (not shown in the drawings) are displayed on the LCD 7 (step S458). When the OK key is selected, a message that prompts the user to change the holding position of the sewing target object 39 and an OK key (not shown in the drawings) are displayed on the LCD 7 (step S459). After the message has been displayed, the user changes the holding position of the sewing target object 39 with respect to the embroidery frame 84 from, for example, the temporary holding position that corresponds to the sewable area 86A shown in FIG. 20 to the second holding position. The second holding position is, for example, the holding position corresponding to a sewable area 86B in which the markers 110 located in the first estimated layout position 110A and the second estimated layout position 110B and the rectangle 206B corresponding to the second pattern can be arranged. The holding position is changed in a state in which the markers 110 are attached to the first estimated layout position 110A and the second estimated layout position 110B. Thus, even when the holding position of the sewing target object 39 with respect to the embroidery frame 84 is changed, the layout of the markers 110 with respect to the sewing target object 39 is not changed.

When the holding position is changed and the OK key (not shown in the drawings) is selected, the CPU 61 displays the second reference setting screen 250 (refer to FIG. 15) on the LCD 7 (step S460). The processing returns to the layout setting processing shown in FIG. 14, and proceeds to the processing at step S331. At step S331, it is determined whether the OK key 259 has been selected. When the OK key 259 has not been selected (no at step S331), the processing returns to step S302 and the processing corresponding to the selected key is performed as described above. When the OK key 259 has been selected (yes at step S331), based on the layout of the markers 110, processing is performed to identify the layout of the first pattern (the (N−1)-th pattern) in the second holding position.

First, the two markers 110 are detected by whole area detection processing (step S332). Content of the whole area detection processing performed at step S332 is the same as the content of the whole area detection processing (refer to FIG. 19) that is performed in the second marker detection processing (refer to FIG. 18), and an explanation thereof is thus omitted here. The layout of the markers 110 with respect to the first reference in the second holding position is identified based on the coordinates of the embroidery coordinate system of the detected markers 110 in the second holding position, and on the first marker layout and the second marker layout stored in the RAM 63 or the temporary marker layout. The identified layout of the markers 110 is stored in the RAM 63 as a third marker layout (step S333).

For example, as shown in FIG. 13, when the holding position is directly changed from the first holding position (which corresponds to the sewable area 86) to the second holding position (which corresponds to the sewable area 86A) without being changed to the temporary holding position, and also when the layout of the second pattern is determined to be the position of a rectangle 206D without changing the first reference, the first marker layout is stored in the RAM 63. Further, when the holding position is changed to the second holding position in the same way, but the layout of the second pattern is determined to be the position of the rectangle 206A after the first reference has been changed, the second marker layout is stored in the RAM 63. In other words, in these cases, the associated relationship between the markers 110 and the first reference before or after the change in the first holding position that corresponds to the sewable area 86 is identified. Further, at a point in time at which the holding position is changed to the second holding position that corresponds to the sewable area 86A, the embroidery coordinate system in the second holding position is set, and the coordinates of the markers 110 in the second holding position are identified by the whole area detection processing at step S332. Therefore, if the coordinates of the first reference (the first line segment 227 and the first point 228) before or after the change in the first holding position are converted to the coordinates in the second holding position, it is possible to associate the markers 110 with the coordinates of the first reference in the second holding position. In other words, the layout of the markers 110 with respect to the first reference before or after the change in the second holding position that corresponds to the sewable area 86A can be identified as the third marker layout.

On the other hand, as shown in FIG. 20, for example, let us consider a case in which the holding position is changed from the first holding position that corresponds to the sewable area 86 to the second holding position that corresponds to the sewable area 86B via the temporary holding position that corresponds to the sewable area 86A. In this case, the temporary marker layout, namely, the associated relationship between the first reference before or after the change in the temporary holding position and the markers 110 re-attached to the first estimated layout position 110A and the second estimated layout position 110B, is stored in the RAM 63. Also in this case, in the whole area detection processing at step S332, the coordinates of the markers 110 (which are respectively located in the first estimated layout position 110A and the second estimated layout position 110B) in the second holding position are identified. Therefore, if the coordinates of the first reference (the first line segment 227 and the first point 228) before or after the change in the temporary holding position are converted to the coordinates in the second holding position, it is possible to associate the markers 110 with the coordinates of the first reference in the second holding position. In other words, the layout of the markers 110 (which are respectively located in the first estimated layout position 110A and the second estimated layout position 110B) with respect to the first reference before or after the change in the second holding position that corresponds to the sewable area 86B can be identified as the third marker layout.

Next, based on the identified third marker layout and on the relative layout of the second pattern with respect to the layout of the first pattern, the layout of the second pattern (the N-th pattern) with respect to the sewing target object 39 in the second holding position is set (step S334). Specifically, the layout of the second pattern is set based on the associated relationship between the coordinates of the markers 110 and the coordinates of the first reference (the first line segment 227 and the first point 228) in the embroidery coordinate system set in the second holding position, and on the coordinates of the second reference (the second line segment 208 and the second point 209). At step S334, based on a set result, the sewing data of the N-th pattern is corrected. Further, the set result (not shown in the drawings) of the layout of the N-th pattern is displayed on the LCD 7. The set result is shown, for example, by the position and angle of the rectangle that corresponds to the second pattern. After that, a message "Please remove the markers" (not shown in the drawings) is displayed on the LCD 7 (step S335). Next, although not shown in the drawings, a screen provided with the sewing start key and a pattern connecting key is displayed on the LCD 7. This completes the layout setting processing and the processing returns to the main processing.

In the main processing, after the layout setting processing (step S60), the CPU 61 stands by until the pattern connecting key or the sewing start key is selected (no at step S95, no at step S220). When the pattern connecting key is selected (yes at step S95), the processing proceeds to step S100 and the processing that associates the first reference with the layout of the markers 110 is performed as described above using the N-th pattern as the first pattern (step S100 to step S210). When the sewing start key is selected instead of the pattern connecting key (no at step S95, yes at step S220), sewing of the N-th pattern is performed in a similar way to the processing at step S150 (step S230). This completes the main processing.

As explained above, according to the sewing machine 1 of the first embodiment, the relative layout of the second pattern with respect to the first pattern is determined based on the first reference and the second reference that are set in accordance with a command input by the user. In other words, the user can easily set a desired layout relationship between the first pattern and the second pattern if the user sets the first reference and the second reference by selecting the first specifying key and the second specifying key that are respectively displayed on the first reference setting screen 220 and the second reference setting screen 250. Further, after the user has set the first reference temporarily, the user can easily change the first reference by inputting a command again using the first specifying key displayed on the first reference setting screen 220. In this case, the relative layout of the second pattern with respect to the first pattern is determined based on the changed first reference and the second reference. In this way, when the holding position of the sewing target object 39 with respect to the embroidery frame 84 (refer to FIG. 2) is changed from the first holding position to the second holding position and the first pattern and the second pattern are sewn by the sewing machine 1, the user can flexibly set or change the first reference and the second reference, which are references for positioning of the first pattern and the second pattern.

In addition, according to the sewing machine 1, even when the holding position of the sewing target object 39 with respect to the embroidery frame 84 is changed from the first holding position to the second holding position, based on the image data obtained by capturing an image of the sewing target object 39 on which the markers 110 (refer to FIG. 4) are arranged at each of the holding positions, the layout of the markers 110 with respect to the first reference in the second holding position or to the changed first reference is identified. Then, based on the identified layout of the markers 110 and on the relative layout of the second pattern with respect to the first pattern, the layout of the second pattern on the sewing target object 39 in the second holding position is set. Therefore, the sewing machine 1 can sew the first pattern and the second pattern by positioning them such that the first pattern and the second pattern have a layout relationship desired by the user.

Figure 21:
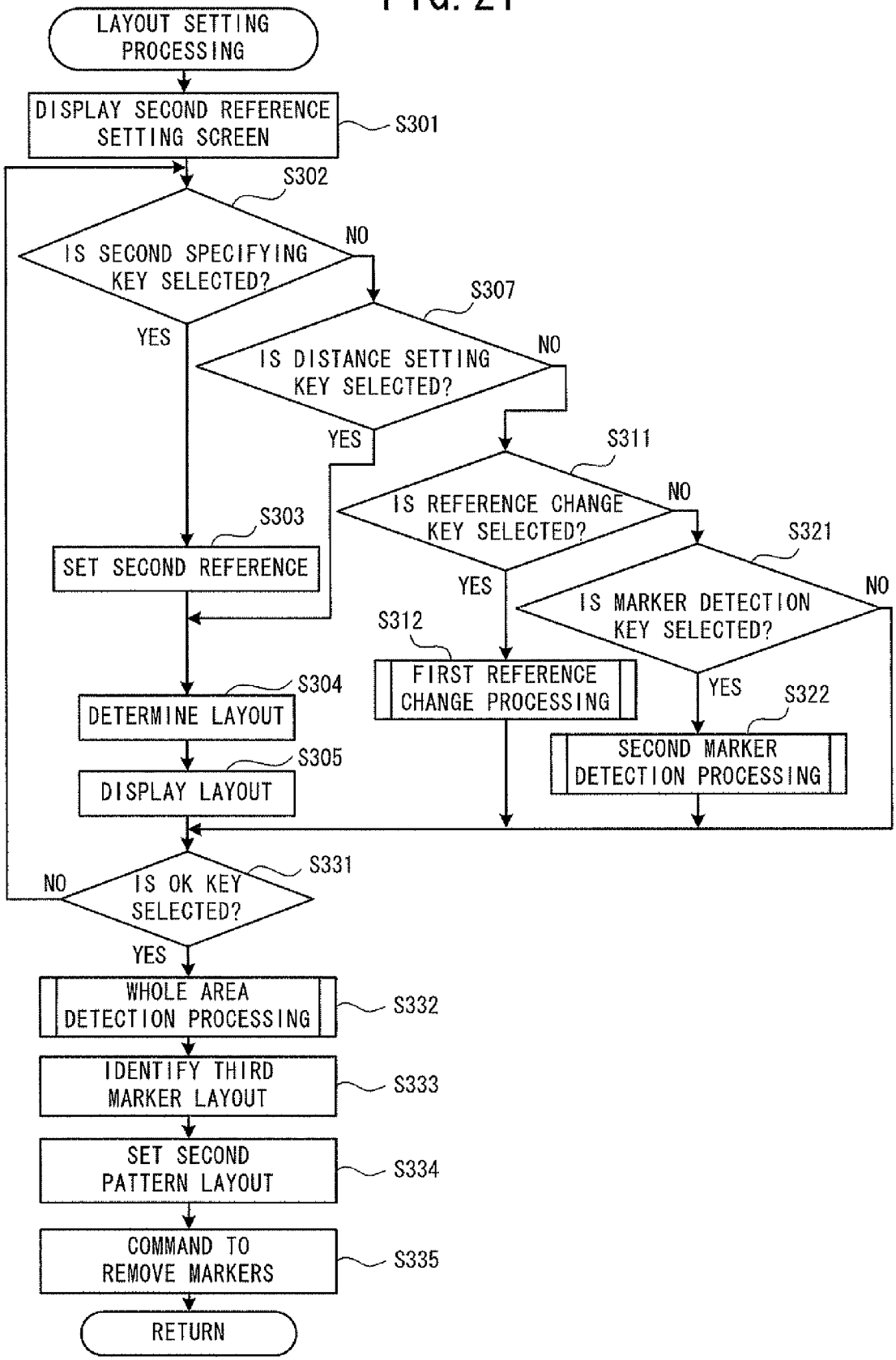
FIG. 21 is a flowchart of layout setting processing according to a second embodiment.

Next, a second embodiment will be explained. A configuration of the sewing machine 1 of the second embodiment is the same as that of the first embodiment, and an explanation thereof is thus omitted. Main processing of the second embodiment is different from the main processing of the first embodiment in layout setting processing at step S60, and other processing is the same as that of the first embodiment. Specifically, in the layout setting processing of the second embodiment, the user can change the relative layout in the embroidery coordinate system of the second reference with respect to the first reference by specifying a distance from the position where the extending direction of the first line segment 227 overlaps with the second line segment 208 and where the first point 228 overlaps with the second point 209. Further, in the second embodiment, content of first reference change processing (step S312) that is performed during the layout setting processing is different from the content of the processing (refer to FIG. 16) of the first embodiment. Hereinafter, the layout setting processing of the second embodiment will be explained with reference to FIG. 21 to FIG. 23, focusing on points that are different from the first embodiment. In FIG. 21, same step numbers are assigned to steps at which the same processing as the layout setting processing of the first embodiment shown in FIG. 14 is performed. Further, in FIG. 22, same step numbers are assigned to steps at which the same processing as the first reference change processing of the first embodiment shown in FIG. 16 is performed.

Figure 23:
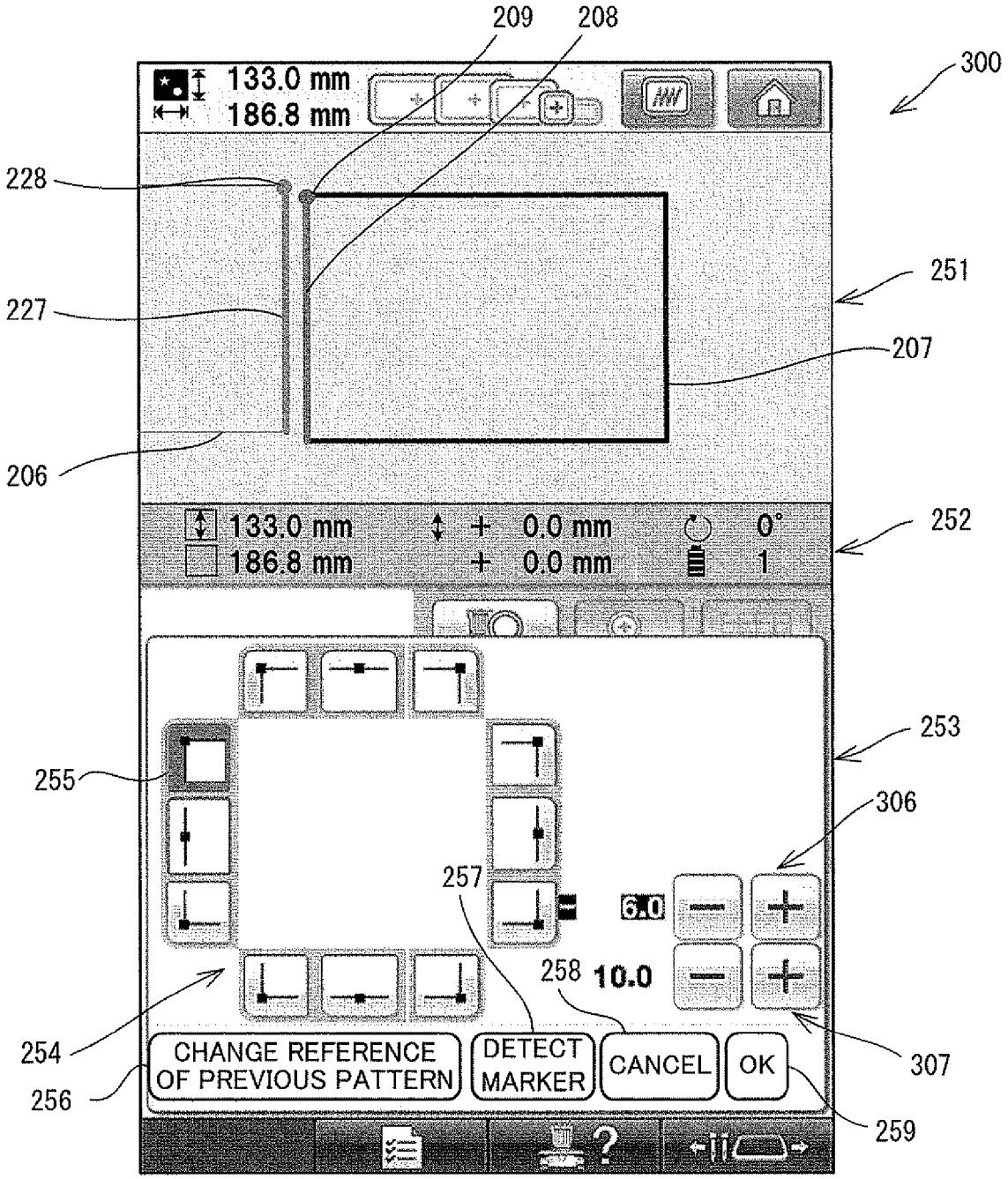
FIG. 23 is an explanatory diagram of a second reference setting screen 300 according to the second embodiment.

First, at step S301 shown in FIG. 21, a second reference setting screen 300 shown in FIG. 23 is displayed. The second reference setting screen 300 is a screen that includes Y-axis direction distance setting keys 306 and X-axis direction distance setting keys 307, in addition to the group of second specifying keys 254 etc. in the command key display column 253 on the second reference setting screen 250 of the first embodiment shown in FIG. 15. The Y-axis direction distance setting keys 306 are keys to specify a relative position, in the Y-axis direction of the embroidery coordinate system, of the second reference with respect to the first reference, using a numerical value in units of mm. The X-axis direction distance setting keys 307 are keys to specify a relative position, in the X-axis direction of the embroidery coordinate system, of the second reference with respect to the first reference, using a numerical value in units of mm. When one of the second specifying keys is selected on the second reference setting screen 300 (yes at step S302), processing from step S303 to step S305 is the same as that of the first embodiment. When none of the second specifying keys is selected (no at step S302), it is determined whether one of the Y-axis direction distance setting keys 306 and the X-axis direction distance setting keys 307 is selected (step S307).

When the Y-axis direction distance setting key 306 or the X-axis direction distance setting key 307 is selected (yes at step S307), the processing proceeds to step S304. Then, the relative layout of the second pattern (the N-th pattern) with respect to the layout of the first pattern (the (N−1)-th pattern) is determined in the following manner. The relative layout of the second pattern with respect to the layout of the first pattern is set based on a position that is moved, by a distance specified by the distance setting key, from an initial position of the second reference with respect to the first reference. The initial position of the second reference with respect to the first reference is the position that is set when one of the second specifying keys included in the group of second specifying keys 254 is selected in the first embodiment, namely, the position where the extending direction of the first line segment 227 overlaps with the second line segment 208 and where the first point 228 overlaps with the second point 209.

The determined layout is displayed in the pattern display column 251 (step S305). In the example shown in FIG. 23, the relative layout of the rectangle 207 representing the second pattern 205 with respect to the rectangle 206 representing the first pattern 205 is displayed in the pattern display column 251, for the case where the distance setting keys 306 and 307 are selected after the second specifying key 255 is selected. Specifically, the relative layout of the rectangle 207 with respect to the rectangle 206 is displayed for the case where the second reference is relatively moved from the above-described initial position by +10.0 mm in the X-axis direction and by −6.0 mm in the Y-axis direction, in accordance with the numerical values specified using the Y-axis direction distance setting key 306 and the X-axis direction distance setting key 307.

Figure 22:
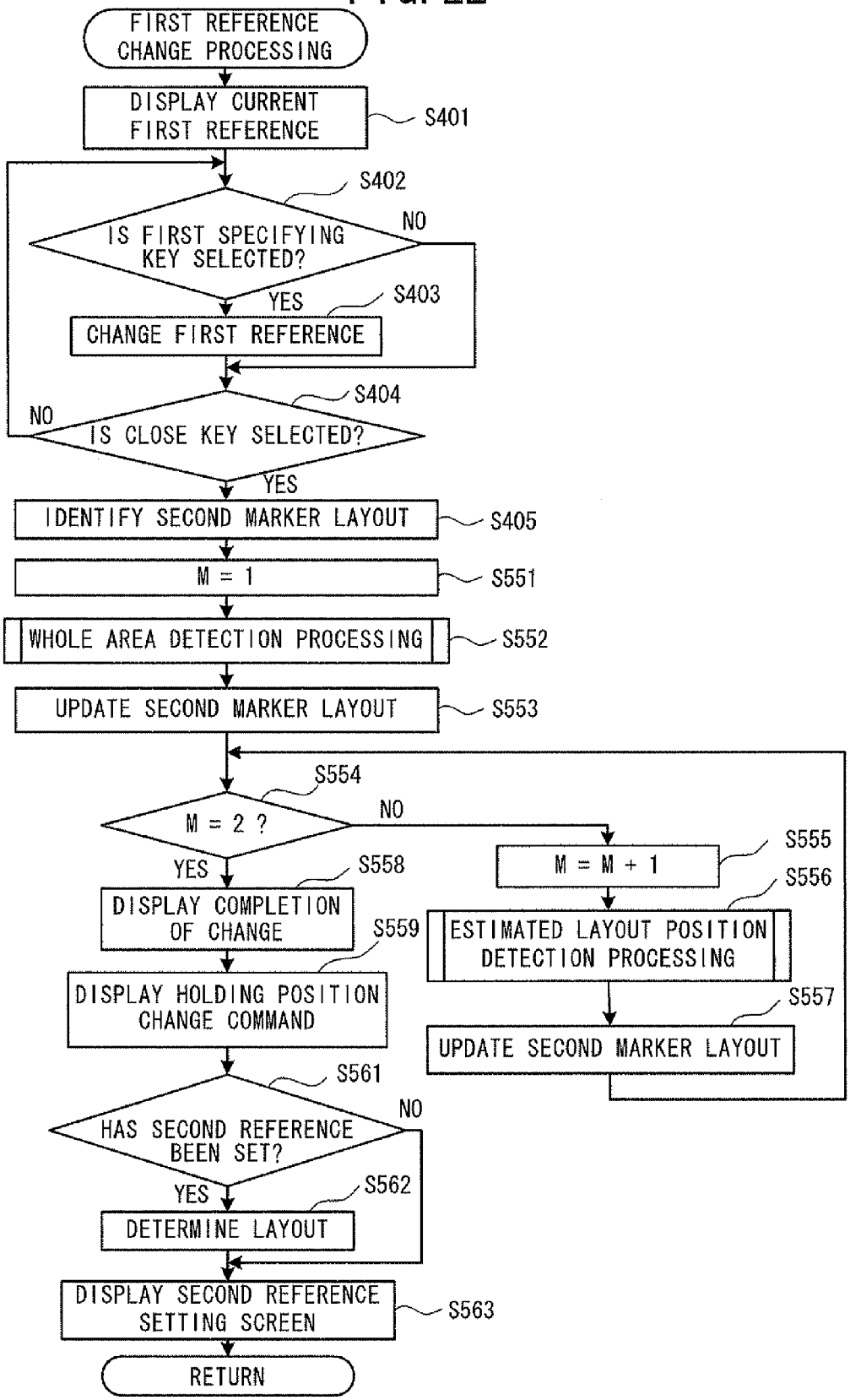
FIG. 22 is a flowchart of first reference change processing according to the second embodiment.

When none of the Y-axis direction distance setting keys 306 and the X-axis direction distance setting keys 307 is selected (no at step S307), it is determined whether the reference change key 256 has been selected (step S311). When the reference change key 256 has been selected, the first reference change processing is performed (step S312, FIG. 22). As shown in FIG. 22, in the first reference change processing of the present embodiment, processing (step S401 to step S405) until the first reference is changed and the second marker layout is identified is the same as the processing (refer to FIG. 16) of the first embodiment. In the first embodiment, after that, the second reference setting screen 250 (refer to FIG. 15) is displayed and the processing returns to the layout setting processing. In contrast to this, in the second embodiment, processing similar to the second marker detection processing performed in the temporary holding position is performed (step S551 to step S559).

Figure 24:
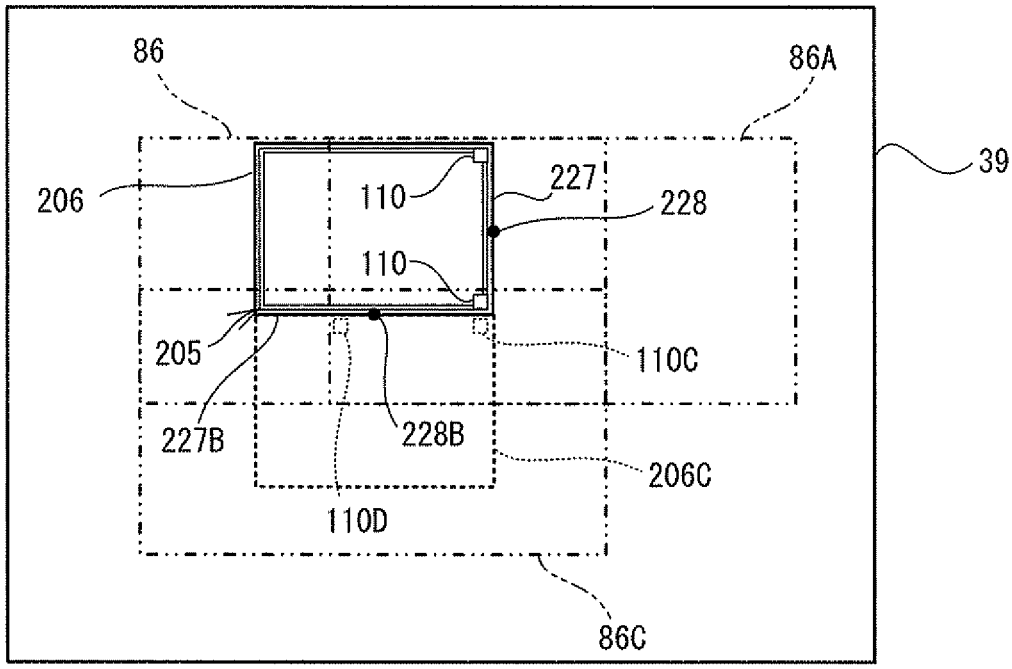
FIG. 24 is still another explanatory diagram illustrating transition states of the holding position of the sewing target object 39 and the layout of the markers 110.

For example, as shown in FIG. 24, in the first holding position corresponding to the sewable area 86, it is assumed that the pattern 205 is sewn after the right side of the rectangle 206 corresponding to the first pattern 205 has been set as the first line segment 227 and the midpoint of the right side has been set as the first point 228. In this case, the two markers 110 are respectively arranged in the vicinities of both the ends of the right side of the rectangle 206 and the first marker detection processing (refer to FIG. 9) is performed. The holding position is changed to, for example, a holding position that corresponds to the sewable area 86A. If the user actually wants to arrange the second pattern in a rectangle 206C and notices that the setting of the first reference is wrong, the user changes the first line segment 227 to, for example, a lower side 227B of the rectangle 206 and changes the first point 228 to a midpoint 228B of the lower side. In this case, since the second pattern cannot be sewn in the holding position that corresponds to the sewable area 86A, the user needs to change the holding position to, for example, a holding position that corresponds to a sewable area 86C.

More specifically, if the first reference is changed after the first pattern has been sewn in the first holding position, in order to sew the second pattern in the second holding position, there is a possibility that another holding position needs to be set temporarily. Therefore, in the first reference change processing of the second embodiment, in a similar manner to the second marker detection processing, the layout of the markers 110 is detected twice, once before and once after the reattachment, using the holding position at a point in time at which the first reference change processing is started as the temporary holding position. Then, the layout of the markers 110 with respect to the changed first reference is updated and stored so that the processing in the second holding position can be reliably performed. The processing at each of the steps from S551 to S559 of the first reference change processing shown in FIG. 22 is substantially the same as the processing at each of the steps from S451 to S459 of the second marker detection processing shown in FIG. 18. Therefore, hereinafter, the processing at each of the steps from S551 to S559 will be explained briefly with reference to the example shown in FIG. 24.

Firstly, first-time detection is performed using the holding position that corresponds to the sewable area 86A as the temporary holding position (step S551, step S552). Based on the coordinates of the markers 110 in the temporary holding position identified by the detection and on the layout of the markers 110 with respect to the changed first reference (the lower side 227B of the rectangle 206 and the midpoint 228B of the lower side 227B) in the first holding position, the layout of the markers 110 before the reattachment with respect to the changed first reference in the temporary holding position is identified. The second marker layout identified at step S405 and stored in the RAM 63 is updated to the newly identified layout (step S553). Subsequently, second-time detection processing is performed (no at step S554, step S555, step S556). In the estimated layout position detection processing at step S556, as shown in FIG. 10, first, the estimated layout position is shown by the red rectangle 245 (refer to FIG. 12) (step S201).

The estimated layout position in this case may be determined in accordance with the changed first reference. For example, as shown in FIG. 24, when the first line segment 227 is changed to the lower side 227B of the rectangle 206 and the first point 228 is changed to the midpoint 228B of the lower side 227B, there is a high possibility that the user wants to arrange the second pattern below the first pattern 205. Therefore, estimated layout positions 110C and 110D are respectively set, for example, in two positions in the sewable area 86A in the vicinities of both the ends of the lower side 227B, which is the changed first line segment. As shown in FIG. 24, since the left end of the lower side 227B is not within the sewable area 86A, the left end of the sewable area 86A is determined as the estimated layout position 110D.

Based on the estimated layout positions that are determined in this way and specified, the estimated layout position detection processing at step S556 is performed. After that, the layout of the markers 110 after the reattachment with respect to the changed first reference in the temporary holding position is identified. Then, the second marker layout that has already been stored in the RAM 63 is updated to the identified layout of the markers 110 (step S557). After that, a message indicating that the layout update is completed is displayed (step S558), and a message that prompts the user to change the holding position is displayed (step S559). In response to this, the user changes the holding position to the second holding position that corresponds to the sewable area 86C shown in FIG. 24. Subsequent processing from step S561 to step S563 is the same as the processing from step S407 to step S409 of the first embodiment shown in FIG. 16. When the first reference change processing shown in FIG. 22 is completed, the processing returns to the layout setting processing shown in FIG. 21. Processing from step S321 to step S335 is the same as the processing of the first embodiment shown in FIG. 14, and an explanation thereof is thus omitted. After that, when processing from step S331 onwards is performed in the layout setting processing shown in FIG. 21, the layout of the second pattern is set with respect to the sewing target object 39 in the second holding position that corresponds to the sewable area 86C shown in FIG. 24, and it is possible to sew the second pattern in the rectangle 206C.

As explained above, according to the sewing machine 1 of the second embodiment, if the first reference is changed, after the second marker layout is identified, the user can re-arrange the markers 110 in appropriate positions corresponding to the changed first reference, in accordance with the estimated layout positions displayed on the LCD 7. Then, based on the image data including the markers 110 arranged in the estimated layout positions, the layout of the markers 110 after the reattachment with respect to the changed first reference is identified, and the second marker layout stored in the RAM 63 is updated. Further, based on the updated second marker layout, the layout of the markers 110 with respect to the changed first reference in the second holding position is identified. Therefore, even when the first reference is changed, the sewing machine 1 of the second embodiment displays the estimated layout positions and thereby prompts the user to arrange the markers 110 in appropriate positions. As a result, it is possible to correctly set the layout of the second pattern on the sewing target object 39 in the second holding position.

The sewing machine of the present disclosure is not limited to the above-described embodiments, and various modifications may be made without departing from the spirit and scope of the present disclosure. For example, modifications from (A) to (E) described below may be made as appropriate.

(A) The configuration of the sewing machine 1 may be changed as appropriate, if necessary. For example, the present disclosure may be applied to an industrial-use sewing machine and a home-use sewing machine. As another example, the type and layout of the image sensor 50 may be changed as appropriate. For example, the image sensor 50 may be an imaging device other than the CMOS image sensor, such as a CCD camera.

(B) It is sufficient if the layout of the first pattern includes at least one of the position and the angle of the first pattern. Similarly, it is sufficient if the layout of the second pattern includes at least one of the position and the angle of the second pattern.

(C) The first reference may be a reference which is specified by the user, and which includes one of the first line segment and the first point that are included in the first graphic that represents a range in which the first pattern is sewn. Similarly, the second reference may be a reference which is specified by the user, and which includes one of the second line segment and the second point that are included in the second graphic that represents a range in which the second pattern is sewn. It is sufficient if the first graphic is a graphic that represents the range in which the first pattern is sewn. The first graphic may be, for example, one of a circle, an ellipse and a polygon in which the first pattern can be arranged, as well as the smallest rectangle in which the first pattern can be arranged. Further, the first graphic may be a contour of the first pattern. Similarly to the first graphic, the second graphic may be a graphic other than the smallest rectangle in which the second pattern can be arranged. It is sufficient if the first point is a point included in the first graphic. The first point may be a chosen point on the first line segment, or may be a point that is not located on the first line segment. Similarly to the first point, it is sufficient if the second point is a point included in the second graphic.

(D) The number of the markers 110 used in the main processing can be changed as appropriate. More specifically, the number of the markers 110 may be one or may be three or more. When the layout of the first pattern is identified based on a plurality of the markers 110, the layout of the first pattern pattern, particularly, an angle of the first pattern can be accurately identified, as compared to a case in which the layout of the first pattern is identified based on the single marker 110. The layout of the markers 110 detected based on the image data may be at least one of the position and the angle of the markers 110. The configuration of the markers 110 may be changed as appropriate. The configuration of the markers 110 includes, for example, a marker size, a material, a design and a color. The reference (the first center point 111 of the marker 110 in the above-described embodiments) to identify the layout of the markers 110, and its calculation method may be changed as appropriate, taking the configuration etc. of the markers 110 into consideration.

(E) The main processing may be changed as appropriate. For example, the following modifications may be made.

(E-1) The method for determining the relative layout of the second pattern with respect to the layout of the first pattern may be changed as appropriate. For example, although in the above-described embodiments, the first reference is specified using the first specifying key and the second reference is specified using the second specifying key, the present disclosure is not limited to this. More specifically, the first reference (the second reference) may be freely specified by the user from among the line segments and points included in the first graphic (the second graphic). As another example, the layout of the second reference with respect to the first reference is not limited to the ease described in the above-described embodiments, and may be changed as appropriate. As another example, a numerical value may be used to specify the angle of the second line segment included in the second reference, with respect to the first line segment included in the first reference. By doing this, the relative layout of the second pattern can be inclined at a desired angle with respect to the layout of the first pattern. As another example, references corresponding to the first reference and the second reference may be automatically set, and the user may numerically set at least one of a positional relationship and an angular relationship between the set references. Examples of the references corresponding to the first reference and the second reference include a representative point of the first graphic (the second graphic) and a representative line segment of the first graphic (the second graphic). Examples of the representative point of the first graphic (the second graphic) include the center point and the end point of the graphic. Examples of the representative line segment of the first graphic (the second graphic) include a diagonal line of the graphic and one of the sides of the graphic.

(E-2) A timing at which the processing is performed to determine the relative layout of the second pattern with respect to the layout of the first pattern may be changed as appropriate. For example, a timing at which each of the first reference and the second reference is acquired may be changed as appropriate. More specifically, after the first pattern is sewn, the processing to acquire the first reference may be performed.

(E-3) In the first holding position and the second holding position, each of the estimated layout positions is not limited to the position exemplified in the above-described embodiments, and may be a position that is inside the embroidery frame 84 and that falls within the image capturing range of the image sensor 50. The estimated layout position may be set by the user, for example. The method for displaying the estimated layout position may be changed as appropriate. Specifically, an estimated position of the center of the marker 110 may be displayed as a pattern, such as a star. Alternatively, an estimated range in which the whole marker 110 can be arranged may be displayed as a graphic, such as a circle, an ellipse or a polygon.

(E-4) Processing that edits the N-th pattern may be performed between step S40 and step S60 of the main processing. Examples of the processing that edits the N-th pattern include a size change, rotation and inversion of the pattern. Further, when the pattern is rotated in the processing that edits the N-th pattern, the graphic that represents the range of the rotated pattern may be reset.

What is claimed is:

1. A sewing machine comprising:

an image capturing device that is capable of capturing an image of a surface of a sewing target object held by an embroidery frame;

a first reference setting portion that sets a reference relating to a first pattern as a first reference in accordance with an input command, the first pattern being a pattern that is sewn in a state in which a holding position of the sewing target object with respect to the embroidery frame is a first holding position and the first reference being used to determine, as a relative layout of a second pattern, at least one of a position and an angle of the second pattern with respect to at least one of a position and an angle of the first pattern, the second pattern being a pattern that is sewn in a state in which the holding position is a second holding position that is different from the first holding position;

a first image data acquisition portion that acquires, as first image data, image data of an image including a marker that is arranged on the surface of the sewing target object, the image being captured by the image capturing device in the state in which the holding position is the first holding position;

a first layout identification portion that, based on the first reference and the first image data, identifies, as a first marker layout, at least one of a position and an angle of the marker with respect to the first reference in the first holding position;

a first reference change portion that, when a change command, which is a command to change the first reference, is input after the first marker layout is identified by the first layout identification portion, changes the first reference in accordance with the change command, and sets the changed first reference;

a second layout identification portion that, when the changed first reference is set by the first reference change portion, identifies, as a second marker layout, at least one of a position and an angle of the marker with respect to the changed first reference in the first holding position, based on the changed first reference and the first marker layout;

a second reference setting portion that sets, as a second reference, a reference relating to the second pattern that is used to determine the relative layout of the second pattern, in accordance with an input command;

a layout determination portion that determines the relative layout of the second pattern based on one of the first reference and the changed first reference and on the second reference;

a second image data acquisition portion that acquires, as second image data, image data of an image including the marker that is arranged on the surface of the sewing target object, the image being captured by the image capturing device in the state in which the holding position is the second holding position;

a third layout identification portion that, based on one of the first marker layout and the second marker layout and on the second image data, identifies, as a third marker layout, at least one of a position and an angle of the marker with respect to one of the first reference in the second holding position and the changed first reference; and a setting portion that, based on the relative layout of the second pattern and on the third marker layout, sets at least one of a position and an angle of the second pattern with respect to the sewing target object in the second holding position.

2. The sewing machine according to claim 1, further comprising:

a display device that displays information;

a display control portion that, when the second marker layout is identified by the second layout identification portion, causes the display device to display an estimated layout position which is a position on the surface of the sewing target object and which is determined in accordance with the changed first reference;

a layout completion reception portion that receives input of layout completion information, which is information indicating that the marker is arranged in the estimated layout position;

a third image data acquisition portion that acquires, as third image data, image data of an image including the marker that is arranged on the surface of the sewing target object, the image being captured by the image capturing device after the layout completion information is received by the layout completion reception portion;

a storage device that stores the second marker layout identified by the second layout identification portion; and an update portion that, based on the second marker layout stored in the storage device and on the third image data, identifies at least one of a position and an angle of the marker arranged in the estimated layout position with respect to the changed first reference, and updates the second marker layout stored in the storage device to the identified at least one of the position and the angle;

wherein the third layout identification portion identifies the third marker layout based on one of the first marker layout and the second marker layout that is stored in the storage device and on the second image data.

3. The sewing machine according to claim 1, wherein the first reference is at least one of a line segment and a point that are included in a range in which the first pattern is sewn, the second reference is at least one of a line segment and a point that are included in a range in which the second pattern is sewn, and the first reference change portion sets the changed first reference by changing the first reference to at least one of another line segment and another point that are included in the range in which the first pattern is sewn.

4. The sewing machine according to claim 3, wherein the first reference setting portion sets the first reference based on a first specifying key on which an input operation is performed, among a plurality of first specifying keys corresponding to combinations of the line segment and the point that are included in the range in which the first pattern is sewn, the second reference setting portion sets the second reference based on a second specifying key on which an input operation is performed, among a plurality of second specifying keys corresponding to combinations of the line segment and the point that are included in the range in which the second pattern is sewn, and the layout determination portion determines, as the relative layout of the second pattern, a layout in which an extending direction of the line segment corresponding to the first specifying key overlaps with the line segment corresponding to the second specifying key and in which the point corresponding to the first specifying key overlaps with the point corresponding to the second specifying key.

5. A computer program product stored on a non-transitory computer-readable medium, comprising instructions for causing a computer of a sewing machine to execute the steps of:

setting a reference relating to a first pattern as a first reference in accordance with an input command, the first pattern being a pattern that is sewn in a state in which a holding position of the sewing target object with respect to the embroidery frame is a first holding position and the first reference being used to determine, as a relative layout of a second pattern, at least one of a position and an angle of the second pattern with respect to at least one of a position and an angle of the first pattern, the second pattern being a pattern that is sewn in a state in which the holding position is a second holding position that is different from the first holding position;

capturing an image of a surface of the sewing target object held by the embroidery frame in the state in which the holding position is the first holding position;

acquiring, as first image data, image data of a captured image including a marker that is arranged on the surface of the sewing target object;

identifying, as a first marker layout, at least one of a position and an angle of the marker with respect to the first reference in the first holding position, based on the first reference and the first image data;

changing, when a change command, which is a command to change the first reference, is input after the first marker layout is identified, the first reference in accordance with the change command, and setting the changed first reference;

identifying as a second marker layout, when the changed first reference is set, at least one of a position and an angle of the marker with respect to the changed first reference in the first holding position, based on the changed first reference and the first marker layout;

setting, as a second reference, a reference relating to the second pattern that is used to determine the relative layout of the second pattern, in accordance with an input command;

determining the relative layout of the second pattern based on one of the first reference and the changed first reference and on the second reference;

capturing an image of the surface of the sewing target object held by the embroidery frame in the state in which the holding position is the second holding position;

acquiring, as second image data, image data of a captured image including the marker that is arranged on the surface of the sewing target object;

identifying, as a third marker layout, at least one of a position and an angle of the marker with respect to one of the first reference in the second holding position and the changed first reference, based on one of the first marker layout and the second marker layout and on the second image data; and setting, based on the relative layout of the second pattern and on the third marker layout, at least one of a position and an angle of the second pattern with respect to the sewing target object in the second holding position.

6. The computer program product according to claim 5, further comprising:

displaying, when the second marker layout is identified, an estimated layout position which is a position on the surface of the sewing target object and which is determined in accordance with the changed first reference;

receiving input of layout completion information, which is information indicating that the marker is arranged in the estimated layout position;

acquiring, as third image data, image data of an image including the marker that is arranged on the surface of the sewing target object, the image being captured after the layout completion information is received;

storing the identified second marker layout; and identifying, based on the stored second marker layout and on the third image data, at least one of a position and an angle of the marker arranged in the estimated layout position with respect to the changed first reference, and updating the stored second marker layout to the identified at least one of the position and the angle;

wherein the third marker layout is identified based on one of the first marker layout and the stored second marker layout and on the second image data.

7. The computer program product according to claim 5, wherein the first reference is at least one of a line segment and a point that are included in a range in which the first pattern is sewn, the second reference is at least one of a line segment and a point that are included in a range in which the second pattern is sewn, and the changed first reference is set by changing the first reference to at least one of another line segment and another point that are included in the range in which the first pattern is sewn.

8. The computer program product according to claim 7, wherein the first reference is set based on a first specifying key on which an input operation is performed, among a plurality of first specifying keys corresponding to combinations of the line segment and the point that are included in the range in which the first pattern is sewn, the second reference is set based on a second specifying key on which an input operation is performed, among a plurality of second specifying keys corresponding to combinations of the line segment and the point that are included in the range in which the second pattern is sewn, and the relative layout of the second pattern is a layout in which an extending direction of the line segment corresponding to the first specifying key overlaps with the line segment corresponding to the second specifying key and the point corresponding to the first specifying key overlaps with the point corresponding to the second specifying key.

9. A sewing machine comprising:

an image capturing device that is capable of capturing an image of a surface of a sewing target object held by an embroidery frame;

a memory configured to store computer-readable instructions; and a processor that is configured to execute the computer-readable instructions stored in the memory to:

set a reference relating to a first pattern as a first reference in accordance with an input command, the first pattern being a pattern that is sewn in a state in which a holding position of the sewing target object with respect to the embroidery frame is a first holding position and the first reference being used to determine, as a relative layout of a second pattern, at least one of a position and an angle of the second pattern with respect to at least one of a position and an angle of the first pattern, the second pattern being a pattern that is sewn in a state in which the holding position is a second holding position that is different from the first holding position;

acquire, as first image data, image data of an image including a marker that is arranged on the surface of the sewing target object, the image being captured by the image capturing device in the state in which the holding position is the first holding position;

identify, based on the first reference and the first image data, as a first marker layout, at least one of a position and an angle of the marker with respect to the first reference in the first holding position;

change, when a change command, which is a command to change the first reference, is input after the first marker layout is identified, the first reference in accordance with the change command, and set the changed first reference;

identify, when the changed first reference is set, as a second marker layout, at least one of a position and an angle of the marker with respect to the changed first reference in the first holding position, based on the changed first reference and the first marker layout;

set, as a second reference, a reference relating to the second pattern that is used to determine the relative layout of the second pattern, in accordance with an input command;

determine the relative layout of the second pattern based on one of the first reference and the changed first reference and on the second reference;

acquire, as second image data, image data of an image including the marker that is arranged on the surface of the sewing target object, the image being captured by the image capturing device in the state in which the holding position is the second holding position;

identify, based on one of the first marker layout and the second marker layout and on the second image data, as a third marker layout, at least one of a position and an angle of the marker with respect to one of the first reference in the second holding position and the changed first reference; and set, based on the relative layout of the second pattern and on the third marker layout, at least one of a position and an angle of the second pattern with respect to the sewing target object in the second holding position.

10. The sewing machine according to claim 9, further comprising:

a display device that displays information, wherein the processor further executes the computer-readable instructions to:

cause, when the second marker layout is identified, the display device to display an estimated layout position which is a position on the surface of the sewing target object and which is determined in accordance with the changed first reference;

receive input of layout completion information, which is information indicating that the marker is arranged in the estimated layout position;

acquire, as third image data, image data of an image including the marker that is arranged on the surface of the sewing target object, the image being captured by the image capturing device after the layout completion information is received;

store the identified second marker layout in the memory; and identify, based on the second marker layout stored in the memory and on the third image data, at least one of a position and an angle of the marker arranged in the estimated layout position with respect to the changed first reference, and update the second marker layout stored in the memory to the identified at least one of the position and the angle;

wherein the identifying the third marker layout includes identifying the third marker layout based on one of the first marker layout and the second marker layout that is stored in the memory and on the second image data.

11. The sewing machine according to claim 9, wherein the first reference is at least one of a line segment and a point that are included in a range in which the first pattern is sewn, the second reference is at least one of a line segment and a point that are included in a range in which the second pattern is sewn, and the setting the changed first reference includes setting the changed first reference by changing the first reference to at least one of another line segment and another point that are included in the range in which the first pattern is sewn.

12. The sewing machine according to claim 11, wherein the setting the first reference includes setting the first reference based on a first specifying key on which an input operation is performed, among a plurality of first specifying keys corresponding to combinations of the line segment and the point that are included in the range in which the first pattern is sewn, the setting the second reference includes setting the second reference based on a second specifying key on which an input operation is performed, among a plurality of second specifying keys corresponding to combinations of the line segment and the point that are included in the range in which the second pattern is sewn, and the determining the relative layout of the second pattern includes determining, as the relative layout of the second pattern, a layout in which an extending direction of the line segment corresponding to the first specifying key overlaps with the line segment corresponding to the second specifying key and in which the point corresponding to the first specifying key overlaps with the point corresponding to the second specifying key.

* * * * *